US009950713B2

(12) United States Patent
Senn et al.

(10) Patent No.: US 9,950,713 B2
(45) Date of Patent: Apr. 24, 2018

(54) RAILROAD HOPPER CAR DISCHARGE GATE ASSEMBLY AND RELATED METHOD FOR CONTROLLING DISCHARGE OF MATERIAL FROM A RAILROAD HOPPER CAR

(71) Applicants: Brian A. Senn, South Milwaukee, WI (US); Nicholas B. Earnest, Kenosha, WI (US)

(72) Inventors: Brian A. Senn, South Milwaukee, WI (US); Nicholas B. Earnest, Kenosha, WI (US)

(73) Assignees: POWERBRACE CORPORATION, Kenosha, WI (US); MINER ENTERPRISES, INC., Geneva, IL (US)

( * ) Notice: Subject to any disclaimer, the term of this patent is extended or adjusted under 35 U.S.C. 154(b) by 349 days.

(21) Appl. No.: 14/961,099

(22) Filed: Dec. 7, 2015

(65) Prior Publication Data

US 2017/0158207 A1 Jun. 8, 2017

(51) Int. Cl.

| | |
|---|---|
| ***B61D 7/26*** | (2006.01) |
| ***B61D 7/20*** | (2006.01) |
| ***B61D 7/02*** | (2006.01) |

(52) U.S. Cl.

CPC ..... *B61D 7/02* (2013.01); *B61D 7/20* (2013.01); *B61D 7/26* (2013.01)

(58) Field of Classification Search

CPC ... B61D 7/02; B61D 7/20; B61D 7/26; B61D 7/16; B61D 7/24; B65D 90/587

See application file for complete search history.

(56) References Cited

U.S. PATENT DOCUMENTS

| | | | | |
|---|---|---|---|---|
| 3,332,363 | A * | 7/1967 | Becker | B61D 7/20 105/280 |
| 3,393,017 | A * | 7/1968 | Smith | B61D 5/004 406/130 |
| 3,577,680 | A * | 5/1971 | Nagy | B65D 90/587 105/253 |
| 5,829,359 | A | 11/1998 | Dohr et al. | |

(Continued)

OTHER PUBLICATIONS

International Searching Authority; International Search Report regarding PCT/US2016/064327; dated Feb. 16, 2017; 2 pages.

(Continued)

*Primary Examiner* — Mark T Le

(74) *Attorney, Agent, or Firm* — Law Office of John W. Harbst

(57) ABSTRACT

A railroad hopper car discharge gate assembly has first and second elements arranged in vertically stacked relationship relative to each other for controlling discharge of material from a hopper car. First and second drive mechanisms move the first and second elements, respectively, between closed and open positions. A lock assembly including first and second locks serve to maintain the first and second elements, respectively, in a closed position. The gate assembly also includes a mechanical system for positively removing the first and second locks from a locked condition relative to their respective element upon rotation of either drive mechanism. A method for controlling discharge of material through an opening defined by the railroad hopper discharge gate assembly is also provided.

56 Claims, 22 Drawing Sheets

(56) References Cited

U.S. PATENT DOCUMENTS

| | | | | |
|---|---|---|---|---|
| 6,123,030 | A | 9/2000 | Dohr et al. | |
| 6,263,803 | B1 * | 7/2001 | Dohr | B61D 7/20 105/282.1 |
| 6,357,361 | B2 | 3/2002 | Dohr | |
| 6,412,421 | B2 | 7/2002 | Dohr et al. | |
| 6,412,422 | B2 | 7/2002 | Dohr et al. | |
| 7,367,271 | B2 | 5/2008 | Early | |
| 7,497,170 | B2 | 3/2009 | Fortuna et al. | |
| 2002/0011175 | A1 * | 1/2002 | Dohr | B61D 7/20 105/247 |
| 2002/0073883 | A1 * | 6/2002 | Lucas | B61D 7/20 105/247 |
| 2005/0081741 | A1 * | 4/2005 | Fortuna | B61D 7/20 105/280 |
| 2005/0263031 | A1 * | 12/2005 | Early | B61D 7/20 105/247 |
| 2006/0042499 | A1 * | 3/2006 | Fortuna | B61D 7/26 105/282.1 |
| 2012/0210906 | A1 | 8/2012 | Gaydos et al. | |

OTHER PUBLICATIONS

International Searching Authority; Written Opinion regarding PCT/US2016/064327; dated Feb. 16, 2017; 14 pages.

* cited by examiner

RAILROAD HOPPER CAR DISCHARGE GATE ASSEMBLY AND RELATED METHOD FOR CONTROLLING DISCHARGE OF MATERIAL FROM A RAILROAD HOPPER CAR

FIELD OF THE INVENTION DISCLOSURE

The present invention disclosure generally relates to railroad hopper cars and, more specifically, to a railroad hopper car discharge gate assembly which allows materials to be discharged from the hopper car either pneumatically or gravitationally.

BACKGROUND

Railroad hopper cars are commonly used to transport materials or commodity between distance locations. Railroad hopper cars typically include an underframe for supporting a walled enclosure or hopper in which the materials are held and transported. As is conventional, the underframe of the railcar is supported toward opposite ends by well known wheeled trucks which ride on rails or tracks. A bottom of the walled enclosure or hopper is typically provided with two or more individual discharge openings for allowing the material or commodity to be discharged from the hopper. The hopper on the railcar furthermore typically includes sloped or slanted walls or sheets angularly extending downward toward each discharge opening to promote gravitational movement of the material in the hopper toward the discharge opening.

In the prior art, a combination gravity and pneumatic discharge gate assembly is arranged in registry with each discharge opening on the hopper to selectively control the discharge of material from the hopper of the railcar either by gravity or pressure differential such as vacuum. Such a discharge gate assembly typically includes a frame defining a discharge opening and a first element or gate slidably carried by the frame for movement between closed and open positions. A combination gravity and pneumatic discharge gate also includes a pan assembly or second element, carried by the frame for sliding movement between closed and open positions and beneath the first element or gate.

Most gate assemblies also include a drive mechanism for operably moving the gate between the closed and open positions. When in an open position, the gate allows the material or commodity to gravitationally pass and be discharged from the hopper car. If the gate assembly is to be used for gravitational unloading of the material from the hopper car, the pan assembly or sanitary door must be opened first followed by the gate.

In the event pneumatic discharge of material from the hopper is desired, the gate is first opened to allow material to flow toward the pan assembly or second element. Typically, the pan assembly defines an open ended tube through which material is discharged from the hopper car. A selectively closed cap is provided toward the discharge end of the tube. In some embodiments, the pan assembly is fastened to the walled enclosure or hopper as with a plurality of fasteners. As will be appreciated, however, valuable time is consumed and lost by having to remove the pan assembly from the hopper car when the a gravitational mode of unloading the commodity from the car is selected. Arranging the pan assembly beneath or under the gate also reduces the clearance between the bottom of the gate assembly and the railbed over which the car travels between locations. As will be appreciated by those skilled in the art, the degree of clearance between the underside of the gate assembly and the railbed over which the railcar moves or travels is a serious concern when designing discharge gate assemblies for hopper cars coupled with customer pressures to increase the volumetric payload of each railcar.

Slidably mounting a pan assembly or second element on the gate assembly frame beneath the gate introduces significant design challenges. First, slidably mounting a pan assembly beneath the gate requires a second drive mechanism for moving the pan assembly between closed and open positions. As will be appreciated, providing a second drive mechanism for slidably moving the pan assembly or second element between closed and open positions complicates the design of the gate assembly in several respects. First, spatial requirements for the gate assembly, especially when considering the need for first and second separate and independent drive mechanisms for the first and second elements of the gate assembly, is limited. Second, providing a second drive mechanism on the frame of the gate assembly for sliding the pan assembly or second element between closed and open positions can adversely affect the clearance required between the gate assembly and the railbed. Of course, if the gate assembly is not properly spaced from the railbed, significant damages can occur as the railcar moves between locations. Simply raising the gate assembly, however, reduces the potential volumetric payload or capacity of the car while also raising the railcar's center of gravity Third, the addition of a second drive mechanism complicates the direction which each drive mechanism is to be turned or rotated to effect movement of the particular element on the gate assembly. Moreover, adding another sliding element to the gate assembly requires additional structure for inhibiting inadvertent movements of that second element from the closed position during railcar impacts which are a common occurrence in the railyards as the railcars are connected to each other during the formation of the train consist.

Another concern involving the design and engineering of a railroad hopper car gate assembly relates to the ability to maintain an underside of the gate protected against foreign matter, accumulation of moisture, or insect infiltration. In this regard, some railroad hopper car discharge gate assemblies include a flanged skirt arranged in surrounding relation relative to and in depending relation relative to the discharge opening defined by the frame of the gate assembly. The flanged skirt defines a discharge plenum. Typically an air sled or other form of unloading device is clamped or otherwise releasably secured to a lower flange on the skirt during a gravitational discharge of material.

To inhibit debris, insects and moisture, and other forms of debris from contaminating the underside of the gate and interior of the discharge plenum during transport of the hopper car between locations, such gate assemblies include a sanitary plate or cover element positioned beneath the gate to close the discharge plenum and protect the underside of the gate. Known sanitary plates or cover elements are neither designed nor configured to withstand the columnar load which can be placed thereon by the materials within the hopper and after the gate is moved toward an open position.

As mentioned above, in a railyard during make-up of the train consist and as they travel between locations, railcars can be subjected to numerous impacts, some of which can be severe. For example, when a railroad hopper car moves down a hump in a classification yard, it will impact with other railcars on the track ahead of it and such impacts can be forceful—especially when the railcars are filled with commodity or materials. While shock absorbers are typically built into the coupling units at opposed ends of each railcar, significant impact force are realized between two colliding cars. Such impacts and shocks can affect the position of either gate assembly element, i.e., the sliding gate and/or the second element or pan assembly, due to the inertia of either or both elements.

Accordingly, the gate assembly design can be further complicated by the need for a lock for inhibiting the sliding gate from inadvertently moving from the closed position toward the open position. As will be appreciated, if the gate moves from the closed position toward the open position—even slightly—material within the hopper can be inadvertently lost during transport of the railcar between locations resulting in an economic loss. When the gate assembly embodies a movable pan assembly or second element disposed beneath the gate whereby limiting contamination of the underside of the gate and discharge plenum, the gate assembly design is furthermore complicated by requiring still another lock for inhibiting inadvertent movement of the pan assembly or second element toward the open position from the closed position.

As such, each gate assembly on the railcar is typically provided with some form of locking mechanism for releasably maintaining the gate in a the closed position. The heretofore known locking mechanisms for maintaining the gate in a closed position have a myriad of different designs. Basically, however, such locking mechanisms include some form of mechanical lock which requires manual operation to move the lock from a locked condition to an unlocked condition and then back to a locked condition after the gate is returned to a closed position. Besides adding to the complexity of the gate assembly design, the addition of a second element, which is preferably maintained in a releasably closed position as the railcar moves between locations, also adds to the complexity of the lock assembly design.

For several reasons, the heretofore known manually operated lock mechanisms are constantly being destroyed when the gates are moved from their closed position toward an open position. Typically, and when the railcar arrives at an unloading site, an automatically operated driver engages with the drive mechanism on the gate assembly to move the gate from the closed toward the open position with significant speed. As such, and when the railcar reaches the unloading site, the operating condition of the lock assembly is often overlooked. Alternatively, the manually operated locking mechanisms are initially opened prior to the railcar reaching the ultimate unloading station. Between the time the lock mechanism is initially opened and the time the railcar reaches the unloading station, the railcar may impact with other railcars once or several timers. Occasionally, such shock loads imparted to the railcars can return the locking mechanism to a closed or locked condition. Limited visual access, inconvenient physical access, human error and the increasing demand to unload the railcars as quickly as possible, all contribute to the manually operated locking mechanisms being either substantially damaged or completely destroyed. Also, the high-powered torque drivers used to move the gate from the closed position toward the open position can result in destruction of the locking mechanism. Adding a second manually operated locking mechanism for inhibiting movement of a second element from the closed position only further complicates the gate assembly design.

The American Association of Railways ("AAR") has promulgated regulations dealing with or addressing gravity discharge gate assemblies in operation. The AAR Standard S-233 relates to issues involving hopper railway car outlet discharge gates, installation, the level of forces sustainable by the locking mechanism prior to inadvertent opening, lock operation, seals and a myriad of related gate assembly matters.

As mentioned, railroad hopper cars are used to transport tons of commodity or materials between distance locations. Accordingly, and although there may be multiple discharge gate assemblies arranged on a hopper car, the gate or door of each gate assembly is subjected to extreme columnar loading conditions. Besides being subjected to extreme columnar loading conditions, the materials being transported may be a relatively fine granular material, i.e., cement or the like. Residue of such fine granular materials tends to pass about and around the edges of the door or gate. When subjected to moisture during the course of travel of the railcar, such residue material, when combined with the moisture, can cause significant problems involving sliding the gate from the closed position toward the open position at the discharge station.

Due to the extreme columnar loading conditions on the gate particularly when coupled with the residue material interfering with operation of the gate assembly, a substantially high level of torque is required to be applied to the drive mechanism to move the gate from the closed position toward the open position. The level of torque is such that at least a portion of the drive mechanism is sometimes physically displaced from its normal fixed axis of rotation during the initial opening movements of the gate under the influence of such torque levels. Displacements of the drive mechanism can and often does adversely affect performance and timing of the gate assembly thus resulting in significant operational problems.

Thus, there is a need and continuing desire for a railroad hopper car discharge gate assembly including two elements each movable between a closed and open position and a locking mechanism that addresses and satisfies the drawbacks associated with the known prior art devices.

SUMMARY

In view of the above, and in accordance with this invention disclosure, there is provided a railroad hopper car discharge gate assembly including a frame defining a discharge opening and having a first element carried by the frame for movement between closed and open positions and a second element carried by the frame for movement between closed and open positions. The first and second elements are arranged on the frame in vertically spaced or stacked relation relative to each other. A first drive mechanism, including a first operating shaft assembly, is mounted on the frame for moving the first element relative to the frame. A second drive mechanism, including a second operating shaft assembly, is mounted on the frame for moving the second element relative to the frame. A lock assembly is also carried by the frame. The lock assembly includes a first lock movable between a locked condition, wherein the first lock releasably maintains the first element in the closed position, and an unlocked condition. The lock assembly also includes a second lock movable between a locked condition, wherein the second lock releasably maintains the second element in the closed position, and an unlocked condition. A mechanism is provided for positively moving the first and second locks from their locked condition relative to their respective element upon rotation of either drive mechanism.

In one form, each drive mechanism includes a lost motion connection for allowing the respective drive mechanism to be rotated a predetermined number of degrees during collapse of the lost motion connection before contributing to significant movement of the respective element relative to the frame. Preferably, the first and second drive mechanisms each include a rack and pinion assembly arranged in operable combination with the operating shaft assembly of the respective drive mechanism. Each rack and pinion assembly preferably includes a rack operably associated with a respective element, and with each rack being movable along a predetermined path of travel concomitantly with the respective element.

In one embodiment, a centerline of each operating shaft assembly is disposed to a common vertical side of the of the predetermined path of travel of the respective rack of each rack and pinion assembly. As such, both the first and second drive mechanisms turn or rotate a common direction to open the respective elements and turn or rotate in a common direction to close the respective elements.

In a preferred embodiment, the first element is a discharge gate slidably movable along a generally horizontal path of travel relative to the frame. The discharge gate has an upper surface and a lower surface. In one embodiment, the gate assembly further includes support structure disposed beneath the lower surface of the gate and above the second element. In one form, the second element is a pan assembly slidably movable along a generally horizontal path of travel relative to the frame. The pan assembly preferably defines a pneumatic discharge outlet.

Preferably, each operating shaft assembly includes cam structure for positively removing the locks from their locked condition relative to their respective element upon rotation of either drive mechanism. The cam structures on the first and second operating shaft assemblies are preferably arranged a predetermined number of degrees out of phase relative to each other. In one form, each operating shaft assembly includes an operating shaft rotatably supported on the frame and capstans removably connected to opposite ends of the operating shaft. In one form, the cam structure of each operating shaft assembly is provided on each capstan.

According to another aspect, there is provided a discharge gate assembly for a railroad hopper car. According to this aspect of the invention disclosure, the gate assembly includes a frame configured for attachment to the hopper car and defining a discharge opening. The frame includes a pair of side walls extending generally parallel to a longitudinal axis of the hopper car and a pair of end walls rigidly interconnected to the side walls. The gate assembly also includes a first element carried by the frame for sliding movements in a single generally horizontal path of travel and relative to the discharge opening between closed and open positions and a second element carried by the frame beneath the first element for sliding movements in a single generally horizontal path of travel and relative to the discharge opening between closed and open positions. A first drive mechanism, including a first operating shaft assembly, is mounted on the frame for rotation about a first axis fixed relative to the frame for moving the first element relative to the frame. A second drive mechanism, including a second operating shaft assembly, is mounted on the frame for rotation about a second axis fixed relative to the frame for moving the second element relative to the frame.

A lock assembly is also carried by the gate assembly frame. The lock assembly includes a first lock movable between a locked condition, wherein the first lock extends into the path of travel of the first element when the first element is in the closed position whereby releasably maintaining the first element in the closed position, and an unlocked condition. The lock assembly also includes a second lock movable between a locked condition, wherein the second lock operably extends into the path of travel of the second element when the second element is in the closed position whereby releasably maintaining the second element in the closed position, and an unlocked condition. A mechanism is provided for conjointly and positively removing the first and second locks from the path of travel of their respective element upon rotation of either drive mechanism.

In this embodiment, each drive mechanism preferably includes a lost motion connection for allowing the respective drive mechanism to be rotated a predetermined number of degrees during collapse of the lost motion connection while inhibiting significant movement of the respective element relative to the frame. In one form, the first and second drive mechanisms each include a rack and pinion assembly arranged in operable combination with the operating shaft assembly of the respective drive mechanism. In this embodiment, the lost motion connection of each drive mechanism includes a slotted configuration arranged in pinions of each rack and pinion assembly. Moreover, each rack and pinion assembly includes a pair of racks operably associated with a respective element, with the racks associated with each element being movable along a predetermined path of travel concomitantly with the respective element. In one form, a centerline of each operating shaft assembly is disposed to a common vertical side of the of the predetermined path of travel of the respective racks of each rack and pinion assembly.

Preferably, the racks operably associated with the first element are operably supported by a pair of laterally spaced extensions on the first element and which are slidably carried on the frame. Each extension is laterally disposed outwardly of the side walls of the frame and move with the first element. A non-metallic material is preferably disposed between an underside of each lateral extension on the first element and the frame for operably reducing the coefficient of friction therebetween as the first element is moved between closed and open position relative to the discharge opening defined by the frame.

In one form, the first element of the gate assembly is a discharge gate slidably movable along a generally horizontal path of travel relative to the frame. The gate has an upper surface and a lower surface. Preferably, the gate assembly further includes support structure extending across the discharge opening beneath the lower surface of the gate and above the second element. In one form, the second element of the gate assembly is a pan assembly slidably movable along a generally horizontal path of travel relative to the frame. In one embodiment, the pan assembly defines a pneumatic discharge outlet for effecting the discharge of material from the hopper car.

In a preferred embodiment, each operating shaft assembly includes cam structure for positively removing the locks from the path of travel of their respective element and in timed relation relative to rotation of either drive mechanism. The cam structures on the first and second operating shaft assemblies are preferably arranged a predetermined number of degrees out of phase relative to each other.

In one embodiment, each operating shaft assembly includes an operating shaft rotatably supported on the frame and capstans removably connected to opposite ends of the operating shaft. The cam structure of each operating shaft assembly is preferably provided on each capstan.

According to another aspect of this invention disclosure, there is provided a combination gravity/pneumatic hopper car discharge gate assembly including a four sided frame defining a discharge opening. The gate assembly frame includes a pair of generally parallel side walls having diverging angular surfaces extending upwardly from the discharge opening toward an upper surface of the frame and a pair of generally parallel end walls rigidly secured to the side walls. In one form, the end walls of the frame have diverging angular surfaces extending upwardly from the discharge opening toward the upper surface of the frame. In this embodiment, the frame further includes spaced and generally parallel extensions extending from and generally parallel to the side walls. A gate is carried on the frame for generally linear sliding movements along a predetermined path of travel and in opposed directions between a closed position and an open position. A vacuum pan assembly is carried on the frame beneath the gate for generally linear sliding movements along a predetermined path of travel and in opposed directions between a closed position and an open position. The pan assembly defines a chamber disposed below the gate along with a pneumatic conduit leading therefrom.

In this embodiment, the gate assembly includes a first drive mechanism including a first operating shaft assembly supported for rotation about a first fixed axis by the extensions on the frame for moving the gate between closed and open positions in response to rotation of the first operating shaft assembly. The first fixed axis is arranged above the predetermined path of travel of the gate. In this embodiment, the gate assembly also includes a second drive mechanism including a second operating shaft assembly supported for rotation about a second fixed axis by the extensions on the frame for moving the pan assembly between closed and open positions in response to rotation of the second operating shaft assembly. The second fixed axis is arranged above the predetermined path of travel of the pan assembly.

The combination gravity/pneumatic hopper car discharge gate assembly further includes a lock assembly supported by the extensions on the frame. The lock assembly includes a rock shaft disposed for rotation about a fixed pivot axis disposed between the first and second fixed axes. The lock assembly further including first and second locks mounted on and for rotation with the rock shaft about the pivot axis. The first lock is movable between a locked condition, wherein the first lock extends into the path of travel of the gate when the gate is in the closed position whereby releasably maintaining the gate in the closed position, and an unlocked condition. The second lock is movable between a locked condition, wherein the second lock operably extends into the path of travel of the pan assembly when the pan assembly is in the closed position whereby releasably maintaining the pan assembly in the closed position, and an unlocked condition. In one form, the lock assembly furthermore includes a mechanism for both positively removing the first lock from the path of travel of the gate and positively removing the second lock from the path of travel of the pan assembly in timed relation relative to rotation of either the first or second drive mechanism.

In this embodiment, each operating shaft assembly includes cam structure for positively removing the locks from the path of travel of the respective gate and pan assembly in timed relation relative to rotation of either drive mechanism. The cam structures on the first and second operating shaft assemblies are preferably arranged a predetermined number of degrees out of phase relative to each other. In one form, each operating shaft assembly includes an operating shaft rotatably supported on the extensions and capstans removably connected to opposite ends of the operating shaft. Preferably, the cam structure of each operating shaft assembly is provided on each capstan.

In a preferred form, each drive mechanism includes a lost motion connection for allowing the respective drive mechanism to be rotated a predetermined number of degrees during collapse of the lost motion connection whereby operating the mechanism to conjointly and positively remove the first and second locks from the path of travel of the respective gate and pan assembly prior to significant movement of the respective gate and pan assembly relative to the frame. In this embodiment, the first and second drive mechanisms each include a rack and pinion assembly arranged in operable combination with the operating shaft assembly of the respective drive mechanism. The lost motion connection of each drive mechanism preferably includes a slotted configuration arranged on pinions of each rack and pinion assembly.

Each rack and pinion assembly for the gate assembly preferably includes a pair of racks operably associated with the respective gate and pan assembly. The racks associated with the gate and the pan assembly are each movable along a predetermined path of travel concomitantly with the respective gate and pan assembly. In a preferred embodiment of the gate assembly, the the fixed axis of each operating shaft assembly is disposed to a common vertical side of the predetermined path of travel of the respective racks of each rack and pinion assembly.

In one embodiment, the racks operably associated with the gate are operably supported by a pair of laterally spaced gate extensions slidably carried by the frame. Each gate extension is laterally disposed outwardly of the side walls of the frame and move with the gate. The discharge gate assembly furthermore preferably includes non-metallic material disposed between an underside of each gate extension and the frame for operably reducing the coefficient of friction therebetween as the gate moves between closed and open positions relative to the discharge opening defined by the frame.

According to another aspect of this invention disclosure, there is provided railroad hopper car having an enclosure for holding and transporting material. The enclosure defines toward a bottom thereof an opening through which the material in the enclosure is discharged from the enclosure, and a gate assembly for controlling the discharge of material from the enclosure either pneumatically or gravitationally. The gate assembly includes a frame defining a discharge opening and having a first element carried by the frame for movement between closed and open positions and a second element carried by the frame for movement between a closed and open positions. The first and second elements are arranged on the frame in vertically spaced relation relative to each other. A first drive mechanism, including a first operating shaft assembly, is mounted on the frame for moving the first element relative to the frame. A second drive mechanism, including a second operating shaft assembly, is mounted on the frame for moving the second element relative to the frame. A lock assembly is also carried by the frame. The lock assembly includes a first lock movable between a locked condition, wherein the first lock releasably maintains the first element in the closed position, and an unlocked condition. The lock assembly also includes a second lock movable between a locked condition, wherein the second lock releasably maintains the second element in the closed position, and an unlocked condition. The lock assembly furthermore includes a mechanism for positively removing the first and second locks from their locked condition relative to their respective element upon rotation of either drive mechanism. Preferably, the first and second elements are each carried by the frame for generally parallel movements relative to each other.

Each drive mechanism of the gate assembly includes a lost motion connection for allowing the respective drive mechanism to be rotated a predetermined number of degrees during collapse of the lost motion connection before contributing to significant movement of the respective element relative to said frame. In one form, the first and second drive mechanisms each include a rack and pinion assembly arranged in operable combination with the operating shaft assembly of the respective drive mechanism. Each rack and pinion assembly preferably includes a rack operably associated with a respective element, and with each rack being movable along a predetermined path of travel concomitantly with the respective element. In the preferred embodiment, a centerline of each operating shaft assembly is disposed to a common vertical side of the of the predetermined path of travel of the respective rack of each rack and pinion assembly.

In one form, the first element of the gate assembly is a discharge gate slidably movable along a generally horizontal path of travel relative to the frame. The discharge gate preferably has an upper surface and a lower surface. The railroad hopper car discharge gate assembly further includes support structure extending across the discharge opening beneath the lower surface of the gate and above the second element. In one form, the second element of the gate assembly is a pan assembly slidably movable along a generally horizontal path of travel relative to the frame. The pan assembly preferably defines a pneumatic discharge outlet.

In one form, each operating shaft assembly includes cam structure for positively removing the locks from their locked condition relative to their respective element upon rotation of either drive mechanism. In one embodiment, the cam structures on the first and second operating shaft assemblies are arranged a predetermined number of degrees out of phase relative to each other. Moreover, each operating shaft assembly preferably includes an operating shaft rotatably supported by the frame with capstans removably connected to opposite ends of the operating shaft. In one form, the cam structure of each operating shaft assembly is provided on each capstan.

According to still another aspect of the present invention disclosure there is provided a method for controlling discharge of material through an opening defined by a railroad hopper car. The method includes the steps of: providing a frame configured for attachment to the hopper car and defining a discharge opening arranged in general registry with the opening defined by the hopper car. The frame includes a pair of side walls extending generally parallel to a longitudinal axis of the hopper car and a pair of end walls rigidly interconnected to said side walls. Another step involves: providing a unitary first element carried by the frame for sliding movements in a single generally horizontal path of travel and relative to the discharge opening between closed and open positions. Another step in the methodology involves: providing a second element carried by the frame beneath the first element for sliding movements in a single generally horizontal path of travel and relative to the discharge opening between closed and open positions. Another step involves: providing a first drive mechanism on the frame for rotation about a first axis fixed for moving the first element relative to the frame. Another step involves: providing a second drive mechanism on the frame for rotation about a second fixed axis for moving the second element relative to the frame, with the second axis extending generally parallel to the first axis. Another step involves: arranging a lock assembly on the frame between the first and second drive mechanisms. The lock assembly includes a first lock movable between a locked condition, wherein the first lock extends into the path of travel of the first element when the first element is in the closed position whereby releasably maintaining the first element in the closed position, and an unlocked condition, and a second lock. The second lock is movable between a locked condition, wherein the second lock operably extends into the path of travel of the second element when the second element is in the closed position whereby releasably maintaining the second element in the closed position, and an unlocked condition. The lock assembly furthermore includes a mechanism for conjointly and positively removing the first and second locks from the path of travel of their respective element upon rotation of either drive mechanism.

In one form, the method for controlling discharge of material through the opening defined by the railroad hopper car includes the step of: providing a rack and pinion assembly in operable combination with each element of the gate assembly. Each rack and pinion assembly includes a pair of racks operably associated with a respective element, and with the racks associated with each element being movable along a predetermined path of travel concomitantly with the respective element. Preferably, the method for controlling discharge of material through the opening defined by the railroad hopper car includes the further step of: arranging a centerline of each drive assembly to a common vertical side of the predetermined path of travel of the respective racks of each rack and pinion assembly. In one form, the method for controlling discharge of material through the opening defined by the railroad hopper car includes the step of: supporting the racks operably associated with the first element on a pair of laterally spaced extensions on the first element which are slidably carried on the frame. Each extension is laterally disposed outwardly of the side walls of the frame and move with the first element. Preferably, the method for controlling discharge of material through the opening defined by the railroad hopper car furthermore involves the step of: providing a non-metallic material between an underside of each lateral extension on the first element and said frame for operably reducing the coefficient of friction therebetween as the first element is moved between closed and open positions relative to the discharge opening defined by the frame.

DETAILED DESCRIPTION

Figure 1:
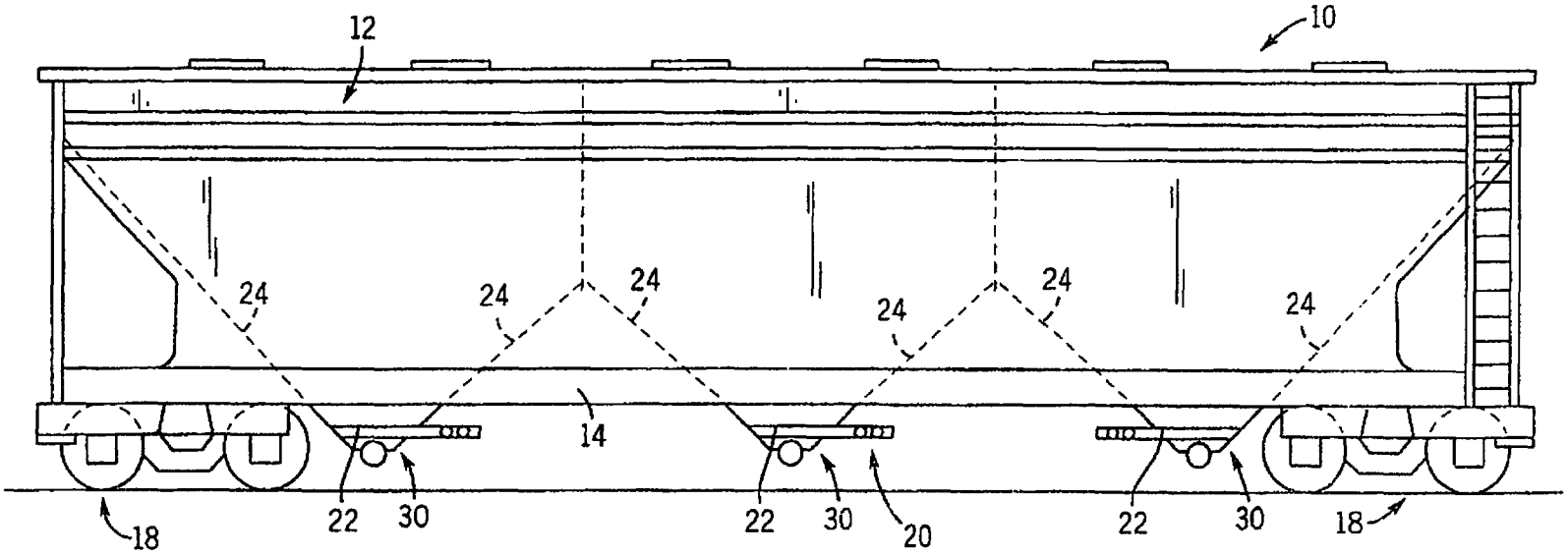
FIG. 1 is a side elevational view of a railroad hopper car equipped with a gate assembly embodying principals of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Referring now to the drawings, wherein like reference numerals indicate like parts throughout the several views, a railroad hopper car, equipped with one or more gate assemblies embodying principals and teachings of the present invention disclosure, is shown in FIG. 1. The railroad hopper car, generally identified by reference numeral 10, includes a walled enclosure or hopper 12 for storing and transporting granular materials therewithin. As known in the art, the hopper 12 is supported on an underframe 14 extending generally the length of the railcar 10. As is typical, the underframe 14 is supported toward opposite ends thereof by conventional wheeled trucks, generally identified by reference numeral 18.

As shown, a bottom 20 of the hopper 12 is provided with a plurality of longitudinally spaced openings 22 for allowing material in the hopper 12 to be discharged from within the hopper 12. As will be appreciated, more or fewer openings than that shown for illustrative purposes can be readily provided on the hopper 12 without detracting or departing from the spirit and novel scope of this invention disclosure. The hopper 12 of railcar 10 typically includes a plurality of conventional slope sheets 24 funneling downward toward each opening at the bottom 20 of the railcar 10 to promote the discharge of material therefrom.

Figure 2:
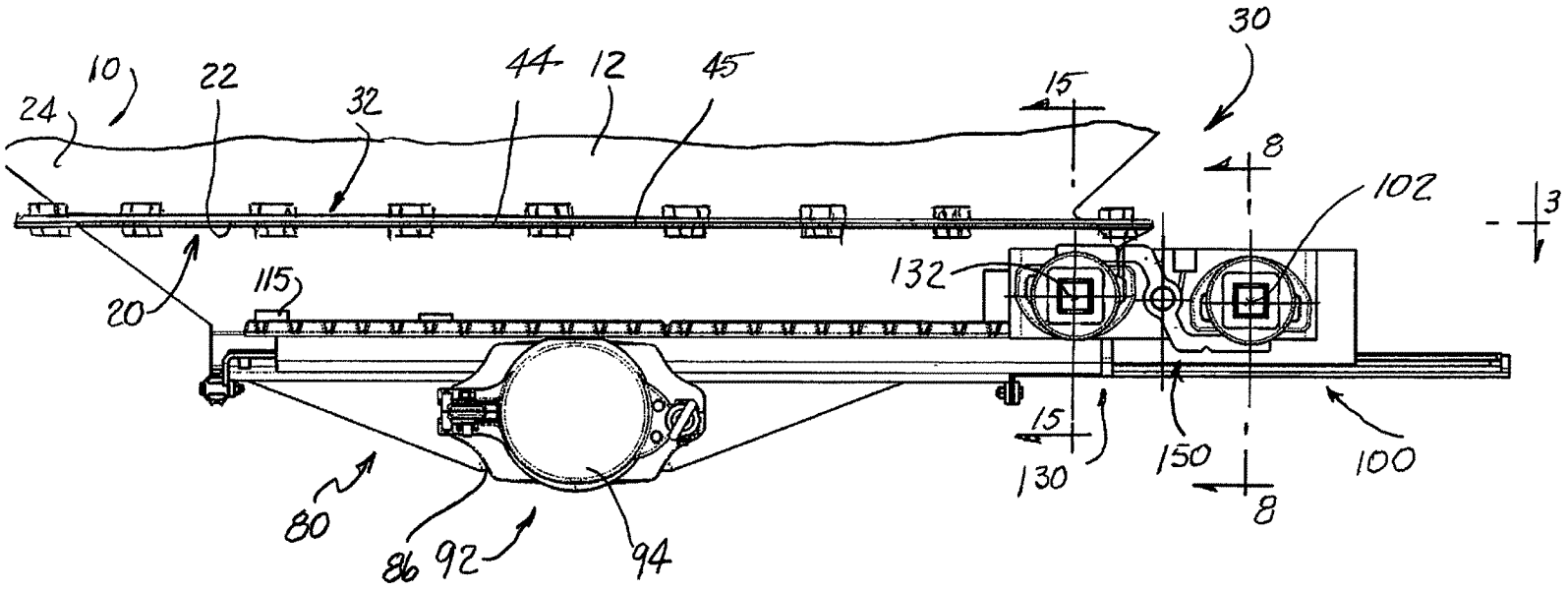
FIG. 2 is an enlarged side elevational view of a gate assembly embodying principals of this invention disclosure.

A gate assembly embodying principals and teachings of the present invention disclosure, and generally designated by reference numeral 30, is shown in FIGS. 1 and 2 in operable combination with the hopper 12 and with each opening 22 defined along the bottom 20 of the hopper car 10. Since the gate assemblies 30 are substantially identical relative to each other, only one gate assembly will be described in detail.

Figure 3:
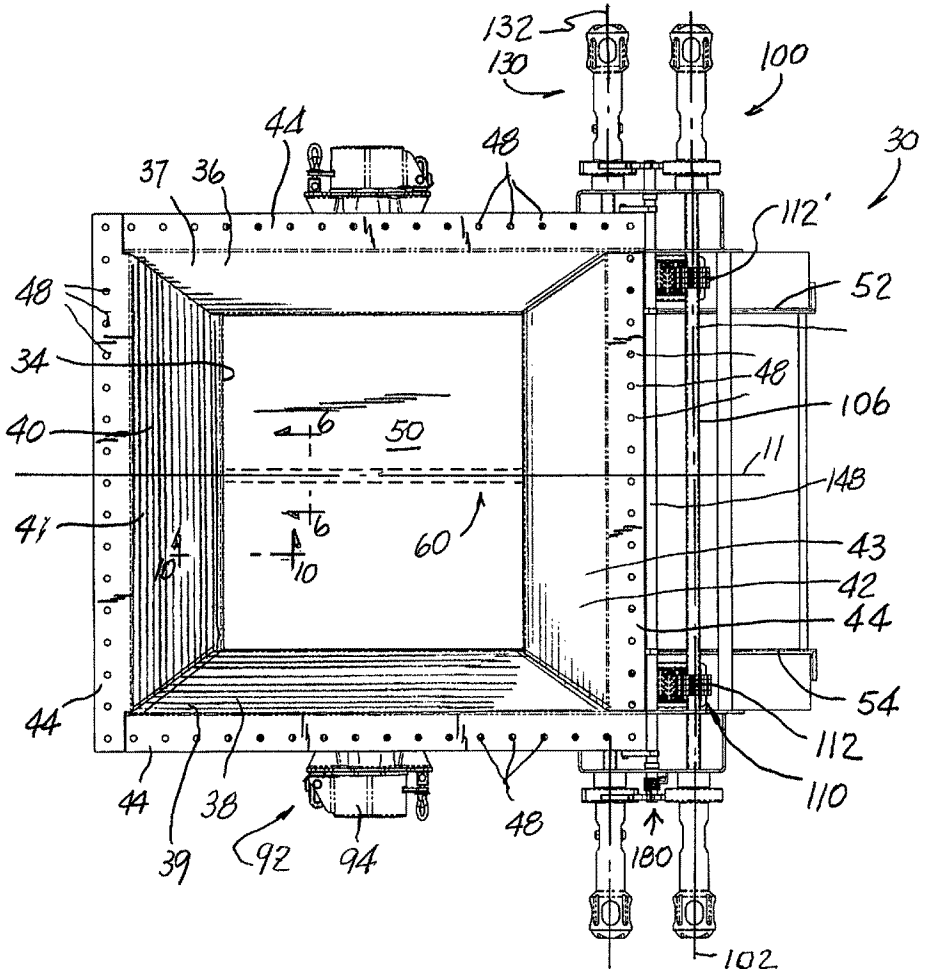
FIG. 3 is a sectional view taken along line 3-3 of FIG. 2.

Each gate assembly 30 includes a rigid frame 32 defining a discharge opening 34 (FIG. 3). In the embodiment illustrated by way of example, the discharge opening 34 has a generally square outer profile. It should be appreciated, however, the gate assembly 30 can readily and easily define a discharge opening 34 having a rectangular opening other than square without detracting or departing from the novel spirit and broad scope of this invention disclosure. Suffice it to say, when gate assembly 30 is attached or otherwise secured to the hopper 12 of railcar 10 (FIG. 2), the discharge opening 34 defined by the frame 32 is arranged in general registry with the respective opening 22 (FIGS. 1 and 2) defined by the hopper 12 of the railcar 10.

As shown in FIG. 3, frame 32 includes opposed and generally parallel side walls 36, 38 extending lengthwise of the railcar and generally parallel to a longitudinal axis 11 of railcar 10 (FIG. 1). Frame 32 also includes opposed end walls 40, 42 extending transversely to the railcar axis 11 and between the side walls 36, 38. In the illustrated form, the side walls 36, 38 and end walls 40, 42 are rigidly interconnected to each other. To promote gravitational movements of material toward the discharge opening 34, and as is conventional, the side walls 36 and 38 of frame 32 are preferably provided with diverging angular surfaces 37 and 39, respectively, extending upwardly from the discharge opening 34 and toward an upper surface 45 (FIG. 2) of frame 32. Similarly, and as is conventional, the end walls 40 and 42 of frame 32, are preferably provided with diverging angular surfaces 41 and 43, respectively, extending upwardly from the discharge opening 34 and toward the upper surface 45 of frame 32 (FIG. 2).

Each side wall 36, 38 and end wall 40, 42 has a mounting flange 44 arranged in generally coplanar relation relative to each other and which define the upper surface 45 (FIG. 2) of the gate assembly 30. As illustrated in FIG. 2, the mounting flanges 44 are configured to mate with respective portions of the hopper 12 to facilitate attachment of the gate assembly 30 to railcar 10. In one form, the flanges 44 define a series of spaced holes 48 allowing for passage of suitable fasteners, such as threaded bolts, therethrough. Of course, other suitable means of attaching the gate assembly frame 32 to respective portions of the hopper 12, such as welding or the like, are equally applicable.

Figure 4:
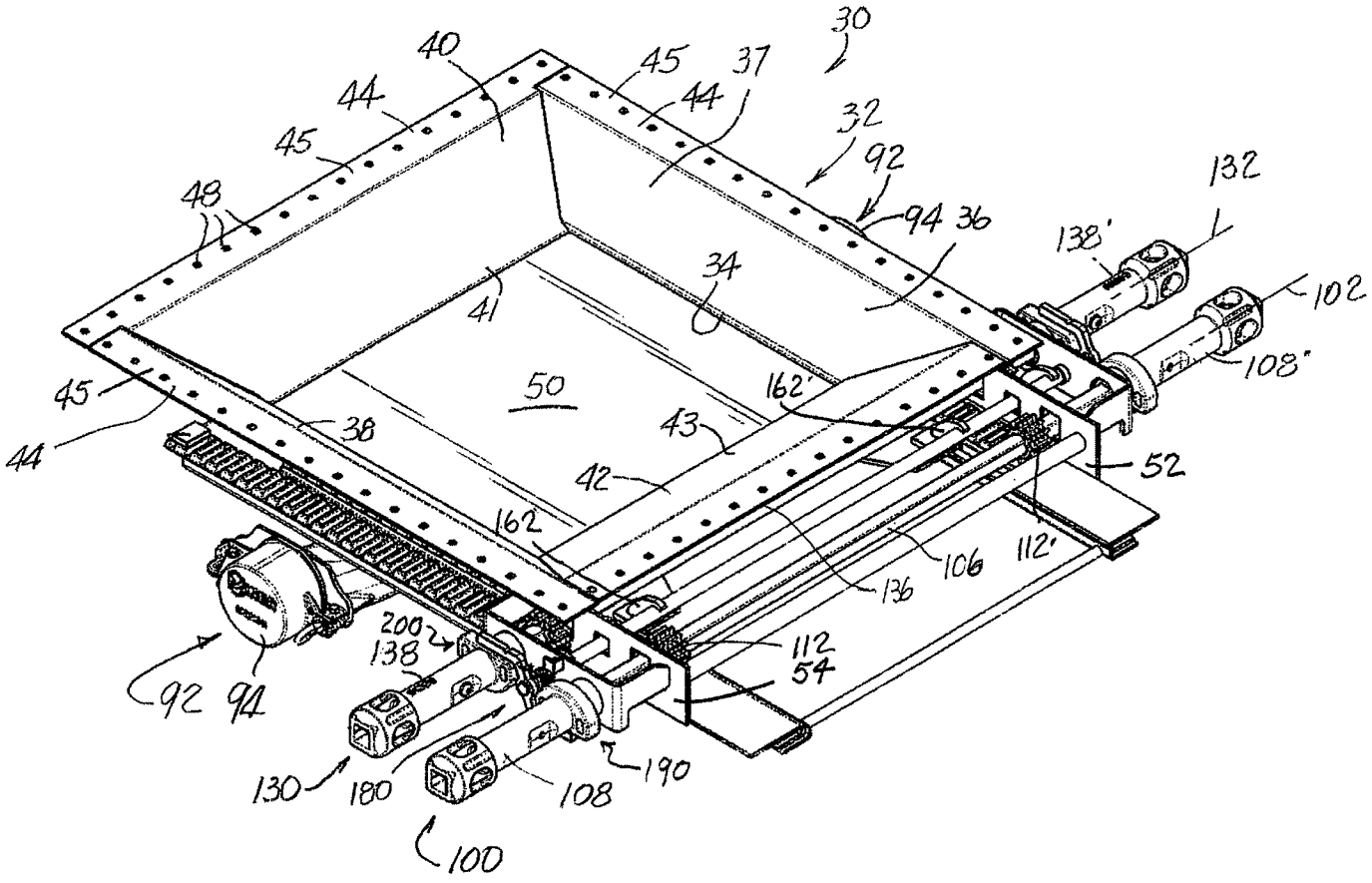
FIG. 4 is a perspective view of the gate assembly shown in FIG. 2.

As shown in FIGS. 3 and 4, gate assembly 30 also includes a preferably unitary gate or first element 50 carried by the frame 32 for sliding movement preferably in a single generally horizontally extending path of travel between a closed position and an open position. In a closed position, the gate or first element 50 extends across and thereby closes the discharge opening 34 defined by frame 32. The gate or first element 50 is movable relative to the gate assembly frame 32 and the discharge opening 34 to an open position to allow material to gravitationally pass from the hopper 12 and through the discharge opening 34. In the illustrated embodiment, the gate assembly frame 32 also includes laterally spaced, frame extensions 52, 54. The frame extensions 52, 54 extend lengthwise of the railcar 10 and generally parallel relative to each other away from end wall 43 on frame 32 and away from the discharge opening 34.

Figure 5:
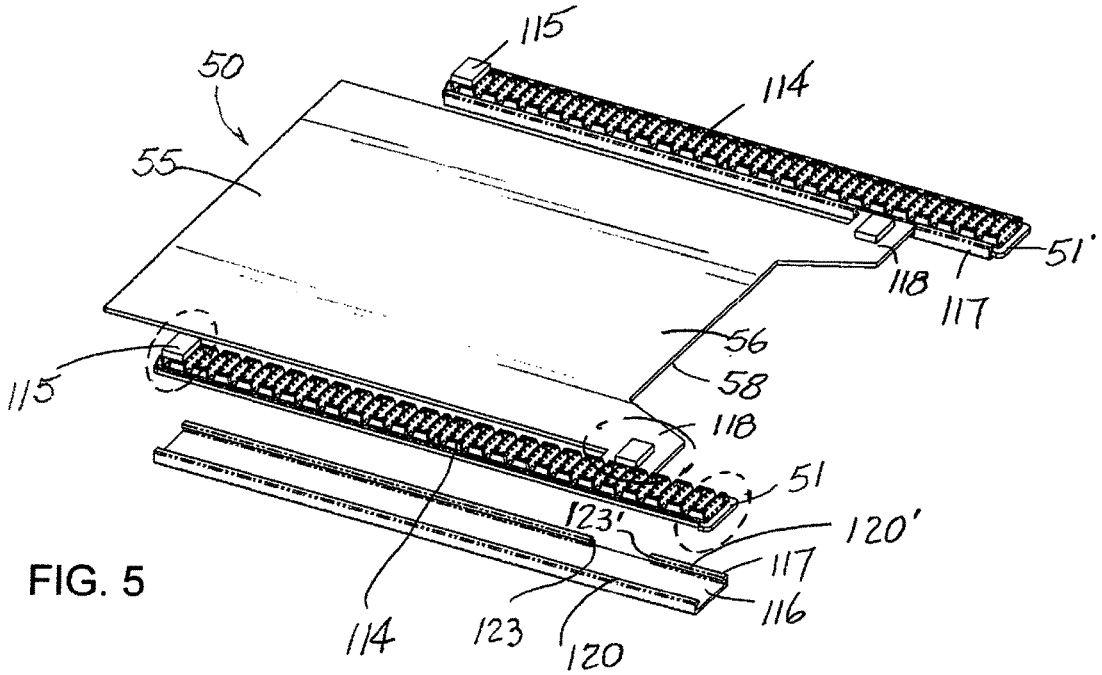
FIG. 5 is a perspective view of one form of a first element or gate forming part of the gate assembly of this invention disclosure.

Turning to FIG. 5, gate 50 is configured as a rigid generally flat plate 55 including upper and lower, generally parallel surfaces 56 and 58, respectively. In the illustrated embodiment, gate 50 has a generally rectangular configuration. Suffice it to say, gate 50 is sized to close the respective opening 22 defined along the bottom 20 of car 10 (FIG. 1) when the gate 50 is in the closed position.

Figure 7:
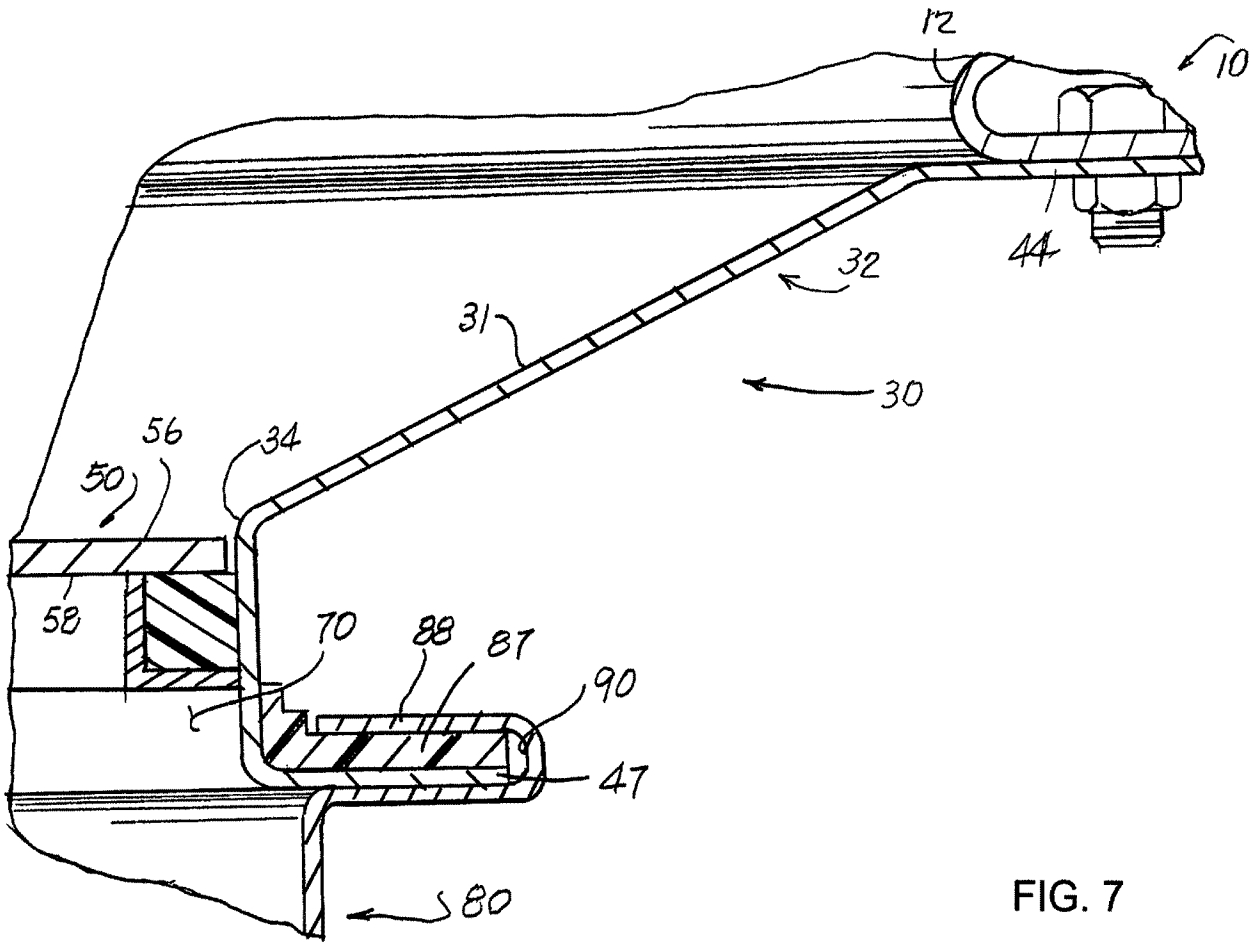
FIG. 7 is an enlarged sectional view taken along line 7-7 of FIG. 3.

As shown by way of example in FIG. 7, the gate assembly frame 32 preferably includes structure 60 for supporting the gate 50, in the closed position. In one form, structure 60 includes a pair of laterally spaced non-metallic runners or supports 61, each carried by and extending for a majority of the length of each side wall 36, 38 of the frame 32 in underlying relation relative to gate 50. In one form, the runners or supports are substantially identical relative to each other. Thus, only the runner 61 associated with the frame side wall 36 is illustrated in FIG. 7. Each runner 61 is preferably formed from a suitable ultra-high molecular weight polyethylene material or the like for reducing the coefficient of friction between the gate 50 and each support 61. As will be appreciated by those skilled in the art, the relationship of the lower surface 58 of gate 50 on the support 61 establishes a seal therebetween which inhibits contaminants, moisture, and insect infiltration from passing between the gate assembly 32 and the door or gate 50.

Figure 6:
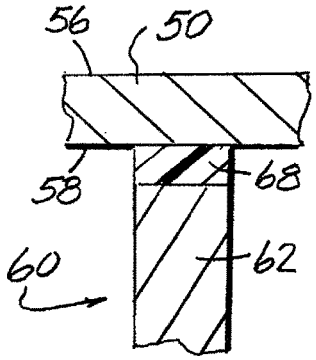
FIG. 6. is an enlarged sectional view taken along line 6-6 of FIG. 3.

As shown in FIG. 3, support structure 60 can furthermore include a generally centralized support 62. Support 62 is securely disposed beneath the closed gate 50 and extends generally parallel to the direction of travel of the gate 50 between closed and open positions. A suitable material 68 (FIG. 6) is preferably disposed between the lower surface 58 of gate 50 and support 62 for enhancing sliding movement of the gate 50 between closed and open positions In one form, material 68 includes ultra-high molecular weight polyethylene or similar material for reducing the coefficient of friction between the gate 50 and the support structure 60.

A lower end of the walls 36, 38, 40 and 42 of the gate assembly frame 32 extend beneath the lower surface 58 of the gate 50 to define a discharge plenum 70 (FIG. 7) arranged below the lower surface 58 of the gate 50. In one form, a lower end of the walls 36, 38, 40 and 42 of the gate assembly frame 32 terminate in an outwardly extending generally horizontal boot flange 47 (with only one flange being shown in FIG. 7) whereby allowing a discharge boot (not shown) to be abutted there against during a discharge operation. In a preferred embodiment, the boot flange 47 is vertically disposed below the lower surface 58 of gate 50. In the illustrated embodiment, the boot flange 47 is spaced from and extends generally parallel to the mounting flange 44 at the upper surface of the gate assembly frame 32.

As shown by way of example in FIGS. 7 and 8, gate assembly 30 furthermore includes a second element 80 carried by the gate assembly frame 32 in vertically spaced or stacked relation below gate 50. In a preferred form, element 80 is disposed and arranged on the gate assembly frame 32 for sliding movements in a single generally horizontal path of travel extending generally parallel to the movements of the first element 50. It is possible, however, to arrange the first element 50 and second element 80 in vertically spaced but non-parallel arrangement without detracting or departing from the spirt and broad scope of this invention disclosure.

Like element or gate 50, the second element 80 likewise extends across the discharge opening 34 defined by the gate assembly frame 32 and is slidably mounted for movements between closed and open positions. In the closed position, the second element 80 extends across the discharge opening 34 and beneath the lower surface 58 of the gate 50 so as to inhibit dirt, moisture and related debris from entering the plenum 70 (FIG. 7) while furthermore inhibiting contamination of the lower surface 58 of the gate 50. In an open position, the second element 80 is removed from beneath the discharge opening 34. Suffice it to say, and regardless of its particular design, the second element 80 of gate assembly 30, when closed relative to the discharge opening 34, is preferably configured and structured to withstand the columnar load of commodity being discharged through opening 34 defined by the gate assembly frame 32.

The second element 80 of the gate assembly 30 is preferably configured as an open-top pan assembly. The pan assembly 80 is arranged in operable combination with the gate assembly 30 for effecting pneumatic discharge of material from the hopper 12 (FIG. 1) of the railcar 10.

Figure 8:
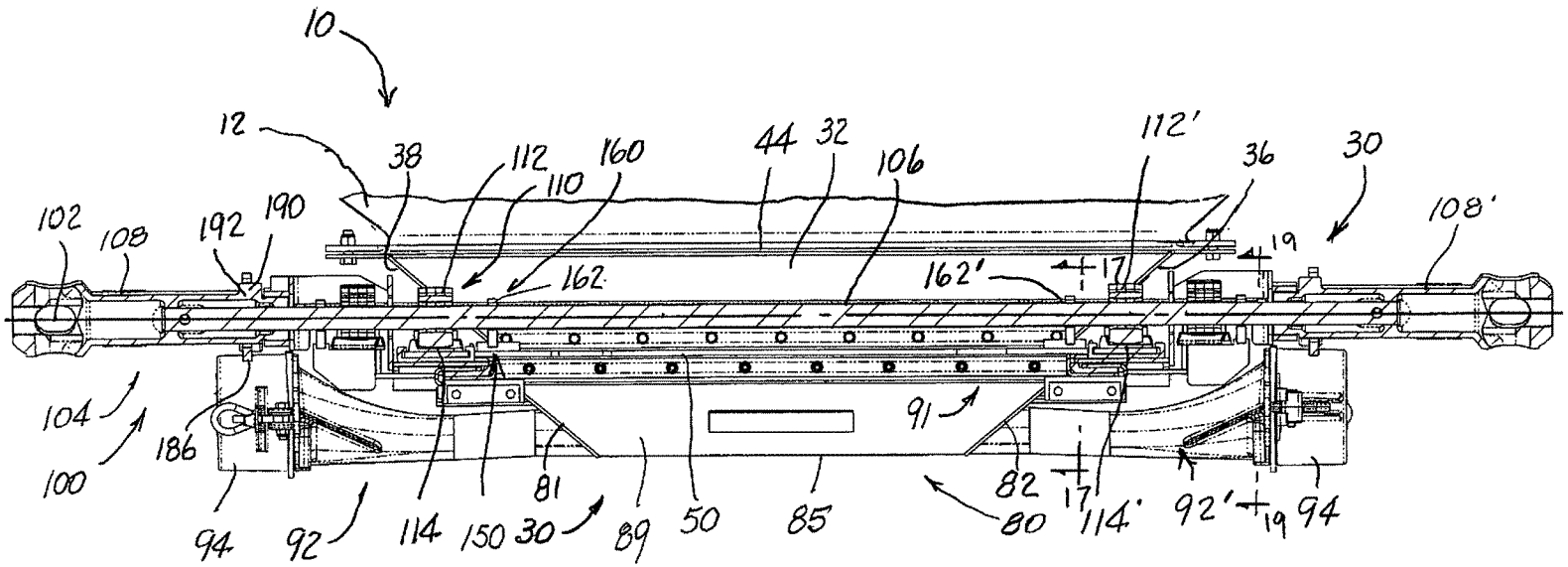
FIG. 8 is a sectional view taken along line 8-8 of FIG. 2.
Figure 9:
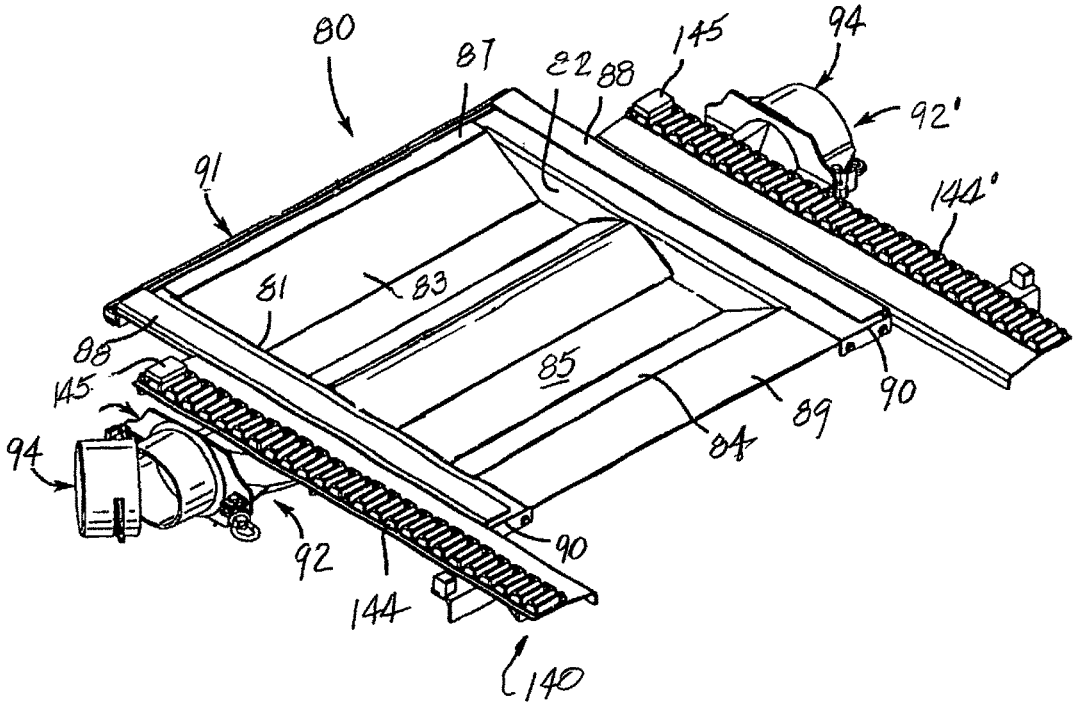
FIG. 9 is a perspective view of one form of a second element or pan assembly forming part of the gate assembly of this invention disclosure.
Figure 10:
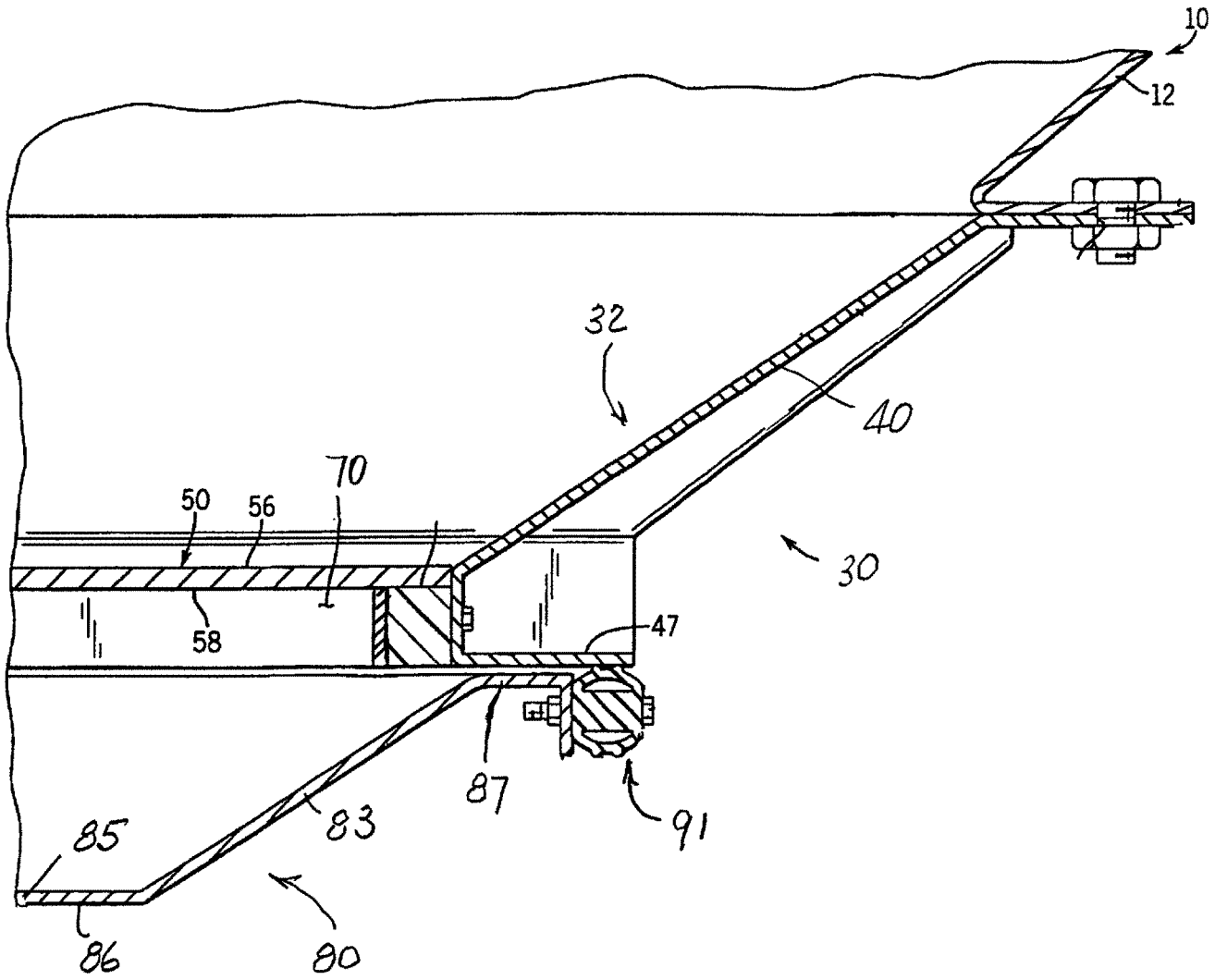
FIG. 10 is an enlarged fragmentary sectional view taken along line 10-10 of FIG. 3.

As shown in FIG. 9, the pan assembly 80 is preferably configured with two laterally spaced side walls 81, 82, two end walls 83, 84 rigidly joined to the side walls 81, 82, and a bottom 85 rigidly interconnected to the walls 81, 82, 83 and 84. An exterior surface on the bottom 85 defines a lower surface 86 (FIG. 8) of the gate assembly 30. The walls 81, 82, 83 and 84 combine with the bottom 85 to effectively close the plenum chamber 70 (FIG. 7) against contaminants when the pan assembly 80 is in the closed position.

In the illustrated embodiment, the upper edges of the side walls 81, 82 of the second element 80 are configured to form mounting flanges 88 which define inwardly opening channels 90. The mounting flanges 88 on the side walls 81, 82 of pan assembly 80 are preferably mirror images of each other and, thus, only the mounting flange 88 associated with side wall 82 of pan assembly is illustrated in FIG. 7. The mounting flange 88 on each side of pan assembly 80 is arranged in operable combination with the respective horizontal boot flange or projection 47 (FIG. 7) preferably extending along the length of the side walls 36, 38 of the gate frame 32 to allow for fore-and-aft sliding movements of the pan assembly or second element 80 along a predetermined path of travel between closed and open positions and beneath the first element or gate 50. It should be appreciated, however, there are other designs which can be used to mount the second element 80 for sliding movement beneath the first element without detracting or departing from the spirit and scope of this invention disclosure.

In a preferred embodiment, and as illustrated by way of example in FIG. 9, upper edges of the end walls 83 and 84 on the pan assembly 80 are each bent outwardly and away from the respective end wall to form flanges 87 and 89, respectively. Preferably, the flange 87 projecting from end wall 83 of pan assembly 80 is arranged generally parallel to but below the boot flange 47 extending from the end wall 40 of the gate assembly frame 32.

In a preferred embodiment, and toward the end walls 83 and 84, the pan assembly 80 also includes suitable seal structure 91 (FIGS. 8 and 9) arranged in operable combination with each flange 87, 89 for inhibiting contaminants, moisture, and insect infiltration from passing between the gate assembly 32 and the second element or pan assembly 80. To enhance sliding movements of the pan assembly 80 relative to the frame 32 and to effectively seal the sides of the pan assembly 80 to the frame 32 thereby inhibiting passage of debris therepast, ultra-high molecular weight polyethylene material 87 (FIG. 7) is preferably arranged between the free ended flange or projection 47 on the frame 32 and the open-sided channel 90 extending along each side of the pan assembly 80.

When the second element 80 is configured as a pan assembly, a discharge outlet 92 is connected to and extends laterally from at least one side and preferably above the bottom 85 of the pan assembly 80. As will be appreciated by those skilled in the art, outlet 92 is arranged in material receiving relation with an interior of the pan assembly 80 beneath the gate 50 and can be used to pneumatically exhaust material from the hopper 12 (FIG. 1). Of course, and without detracting or departing from the spirit and scope of this invention disclosure, a second discharge outlet 92' can be provided in operable combination with an opposite side of the pan assembly 80 for effecting pneumatic discharge of material from hopper 12 (FIG. 1). In a preferred embodiment, a distal end of each discharge outlet 92, 92' on pan assembly 80 is releasably closed by suitable cap structure 94. The cap structure 94 can be of the type disclosed in U.S. Pat. No. 6,357,361 to J. J. Dohr; the applicable portions of which are incorporated herein by reference.

Returning to FIGS. 2 and 3, gate assembly 30 further includes a first drive mechanism 100 and a second drive mechanism 130 for selectively moving the first element 50 (FIG. 3) and the second element 80 (FIG. 2), respectively, relative to the frame 32 of the gate assembly 30 and relative to the discharge opening 34. Drive mechanism 100 is carried on the frame assembly 32 for rotation about an axis 102 which is fixed relative to the frame 32 and preferably extends generally parallel to the end wall 42 of frame 32. Drive mechanism 130 is also carried on the frame 32 for rotation about an axis 132 which is fixed relative to the frame 32 and preferably extends generally parallel to axis 102 of drive mechanism 100.

In one form, and although horizontally separated relative to each other, the drive mechanisms 100 and 130 are preferably arranged in horizontally adjacent relationship relative to each other. In the illustrated embodiment, the fixed axes 102 and 132 of the drive mechanisms 100 and 130, respectively, are preferably disposed in vertically adjacent relationship relative to each other. That is, in the preferred embodiment illustrated in FIG. 2, the fixed axes 102 and 132 of the drive mechanisms 100 and 130, respectively, are disposed a substantially or generally common horizontal plane relative to each other. The phrase "substantially or generally common horizontal plane relative to each other" means the axes 102 and 132 are disposed, within practical limits, a like vertical distance from a common horizontal surface of the gate assembly. In the illustrated embodiment, the practical vertical distance separating the axes 102 and 132 is reduced to beneficially minimize the height of the gate assembly 30 thereby maximizing the payload capacity of the car 10 while conjointly maintaining sufficient clearance between the bottom surface 86 of the gate assembly 30 and the railbed over which car 10 travels between locations.

As illustrated in FIG. 8, drive mechanism 100 preferably includes an operating shaft assembly 104 supported for rotation about the fixed axis 102 by frame 32. In a preferred embodiment, the fixed axis 102 about which the operating shaft assembly 104 turns is disposed to one vertical side of the gate 50. In the illustrated embodiment, the fixed axis 102 about which the operating shaft assembly 104 turns is disposed above the upper surface 56 of gate 50.

Preferably, operating shaft assembly 104 is of multipiece constructions and includes an elongated operating shaft 106 (FIGS. 4 and 8) having capstans or operating handles 108, 108' (FIGS. 4 and 8) arranged toward opposite ends thereof. In one form, the capstans 108, 108' are releasably connected to opposite ends of the operating shaft 106. In a preferred embodiment, the operating shaft 106 has a square cross-sectional configuration. From an understanding of what follows, however, it will be appreciated other cross-sectional configurations for shaft 106 would equally suffice without detracting or departing from the spirit and scope of this invention disclosure. In the illustrated embodiment, the operating shaft assembly 104 is supported for rotation by the frame extensions 52 and 54 (FIG. 3) on the frame 32.

As shown in FIG. 8, drive mechanism 100 further includes a rack and pinion assembly 110 arranged in operable combination with operating shaft assembly 104. The purpose of the rack and pinion assembly 110 is to covert rotary movement of shaft assembly 104 into linear fore-and-aft movement of the first element or gate 50 relative to the frame 32 depending upon the direction of rotation of the operating shaft assembly 104.

As shown, the rack and pinion assembly preferably includes a pair of laterally spaced pinions 112 and 112' mounted on and for rotation with the operating shaft 106 of shaft assembly 104. The pinions are arranged in intermeshing relationship with a pair of racks or toothed tracks 114, 114'.

In the illustrated embodiment, pinions 112, 112' are identical relative to each other, As such, only pinion 112 will be described in detail in connection with FIG. 11. Each pinion preferably has a centralized throughbore or opening 113. The cross-section of each throughbore 113 is designed to allow the pinions to move, within defined limits, along the length of the operating shaft 106. To limit movements of the pinions axially along the length of the operating shaft 106, while eliminating the need for fasteners or the like, each rack is preferably configured with a serpentine design similar to that disclosed in U.S. Pat. No. D427,741 to J. J. Dohr; the applicable portions of which are incorporated herein by reference. Of course, and without detracting or departing from this invention disclosure, and with simple design changes, non-serpentine racks could likewise be utilized as part of each rack and pinion assembly 110.

The racks or toothed tracks 114, 114' of the rack and pinion assembly 110 are preferably fastened or otherwise secured to and concomitantly move with the gate or first element 50 of gate assembly 30. As shown in FIG. 5, a stop 115 is provided toward a distal end of each rack 114, 114' to limit endwise travel or movement of the first element or gate relative to the frame 32.

In the illustrated embodiment, and when the gate 50 is mounted on the frame 32, the racks 114, 114' extend generally parallel to and are disposed outwardly from opposed side walls 36, 38, respectively, of the frame 32. In a preferred form, and in addition to support structure 60, the gate 50 and the racks 114, 114' are operably supported by and for sliding movements relative to the frame 32 by a pair of laterally spaced extensions or wings 51, 51' (FIG. 5) which are joined to but laterally separated from the gate 50. In one form, and when gate 50 is mounted on the frame 32, the extensions or wings 51, 51' and the racks 114, 114', respectively, carried thereby are disposed outwardly from and to opposed sides of both the discharge opening 34 and the plenum 70 defined by the gate assembly frame 32.

Figure 12:
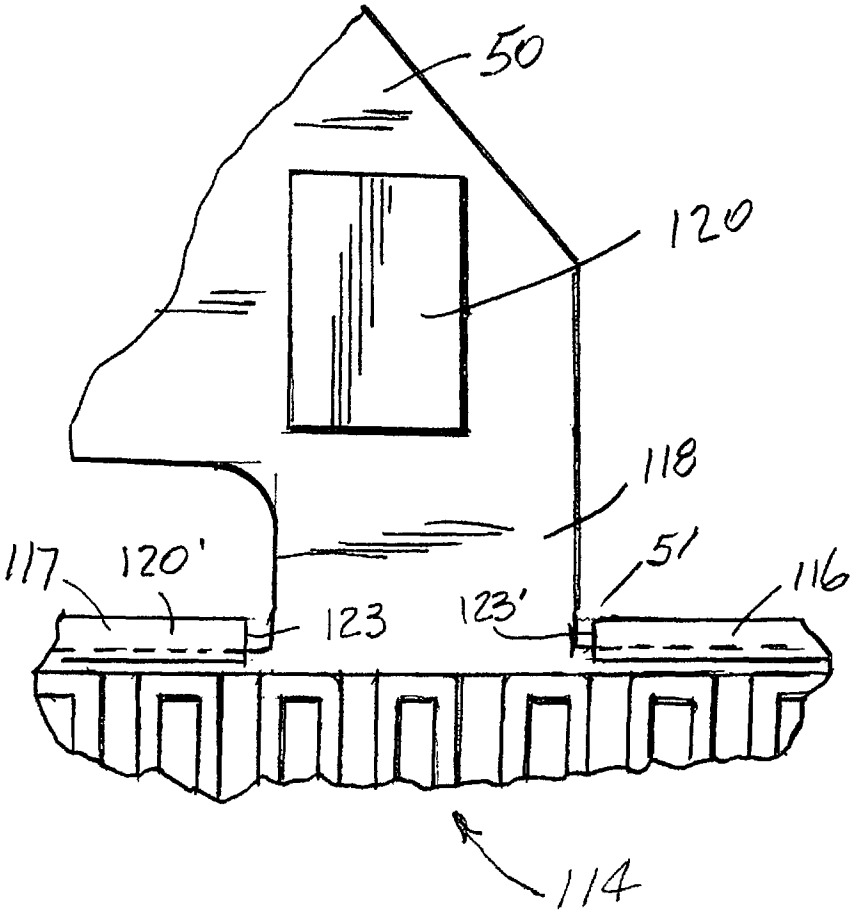
FIG. 12 is an enlarged fragmentary plan view of the area encircled in phantom lines in FIG. 5
Figure 13:
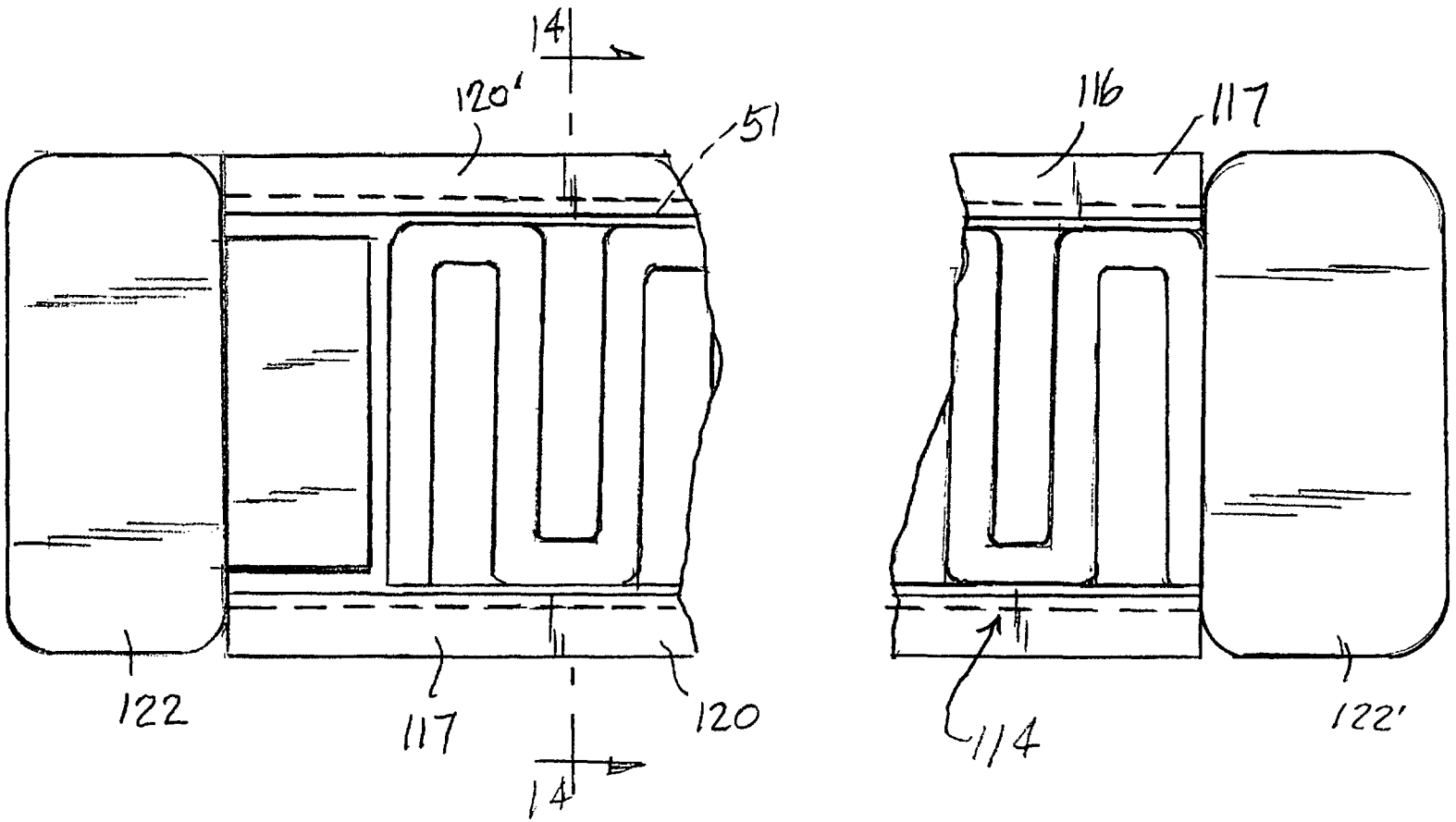
FIG. 13 is an enlarged fragmentary plan view of those areas encircled in dash lines in FIG. 5.

In one form, the wings 51, 51' on opposed sides of the gate 50 are substantially identical relative to each other. Accordingly, only the wing 51 and its operable association with gate 50 will be discussed in detail regarding FIGS. 12, 13 and 14. As shown in FIG. 5, each extension 51, 51' is preferably connected to the remainder of the gate 50 through a laterally extending connecting portion 118 disposed toward a rear end of the gate 50 away from that portion of the gate 50 arranged in underlying relation to the discharge opening 34 when the gate 50 is in the closed position.

In a preferred embodiment, each extension or wing 51, 51' and the respective rack 114,114' carried thereby is disposed in elevated relation relative to the underlying supporting portion of the gate assembly frame 32 so as to enhance sliding movements of the extensions or wings 51, 51' on the gate assembly frame 32. Several designs can be used to effect these desirous ends. In the illustrated embodiment, a lightweight thermoplastic material, such as an ultra-high molecular weight thermoplastic axially elongated strip 116 underlies a major length of each extension on the gate and extends over the underlying portion of the assembly frame 32 thereby significantly reducing the coefficient of friction and, thus, enhancing the ability of the gate 50 to slidably move with the extensions and racks relative to the gate assembly frame 32.

In the exemplary embodiment illustrated in FIGS. 5, 12, 13 and 14, and to enhance repair/replacement of the material strip 116, if and when required, the material strip 116 is releasably secured to the underside of each extensions 51, 51'. There are several designs for effecting these desirous ends. In a preferred form shown in FIGS. 13, 14 and 15, each material strip 116 is releasably secured to the underside of the respective extension as through interlocking instrumentalities 117 between the extension 51, 51' and the respective material strip 116.

Figure 14:
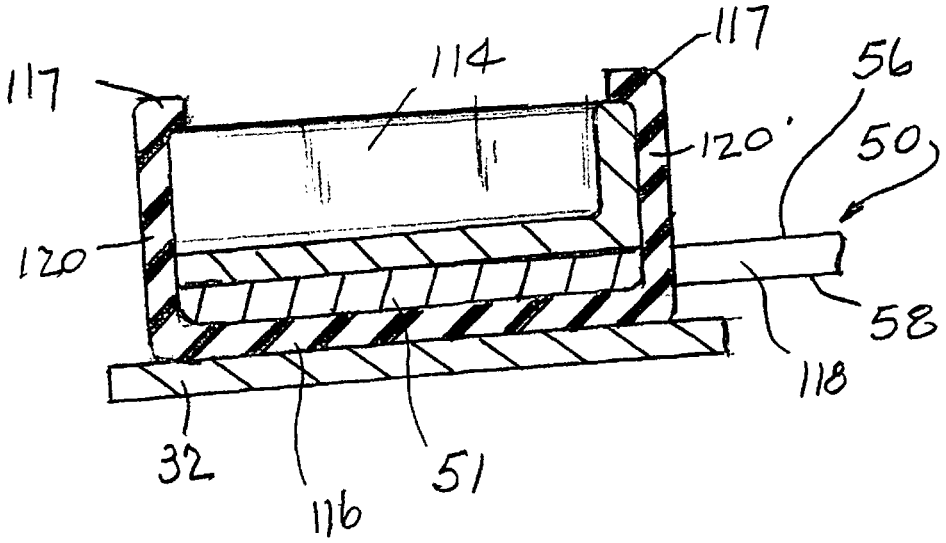
FIG. 14 is an enlarged fragmentary sectional view taken along line 14-14 of FIG. 13.

In one form, the interlocking instrumentality illustrated by way of example in FIG. 14, includes arms or projections 120, 120' extending upwardly and along opposed sides of and for a majority of the length of strip 116. An upper end of each arm or projection 120, 120' releasably fits over and releasably engages with the respective extension on the gate 50 whereby releasably attaching the material strip 116 to the gate 50.

To inhibit endwise shifting movements of the strip 116 relative to the respective extension or wing 51, 51' as the gate 50 moves between positions, the effective length of the strip 116 is preferably sized to be endwise entrapped between linearly spaced stops 122, 122' (FIG. 13) on the respective extension. Returning to FIG. 12, and to further facilitate concomitant movements between the gate 50, the extensions or wings 51, 51' and the material strip 116, and, in those embodiments wherein the effective length of the strip 116 extends past the respective connecting portion 118 on the gate 50, a lengthwise section of the upstanding arm 120' underlying the respective connecting portion 118 on the gate 50 is channeled or otherwise removed whereby providing two fore-and-aft separated shoulders 123, 123' having an effective distance therebetween generally equal to the width of the connecting portion 118 interconnecting each extension 51, 51' to the remainder of the gate 50. As such, the distance between the shoulders 123, 123' defined by the material strip 116 advantageously entraps the width of the gate connecting portion 118 therebetween. Because of its entrapped relationship relative to the respective connecting portion 118 on the gate 50, the material strip 116 is forced to move with the respective extension 51, 51' as the first element or gate 50 moves between positions relative to the frame 32. If and when the material strip 116 requires repair/replacement, the material strip 116 is simply freed from its operable association with the respective gate extension.

Figure 15:
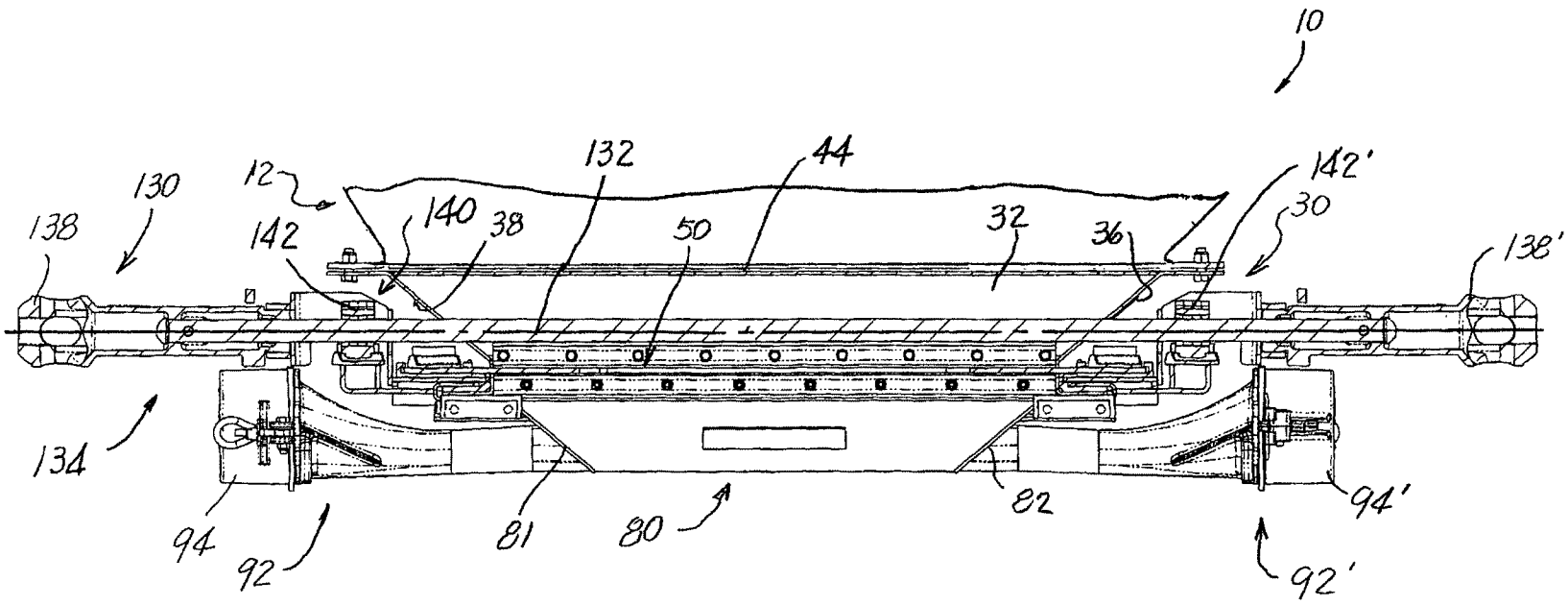
FIG. 15 is a sectional view taken along line 15-15 of FIG. 2.

As illustrated in FIGS. 3 and 15, drive mechanism 130 preferably includes an operating shaft assembly 134 supported for rotation about the fixed axis 132 by frame 32. In a preferred embodiment, the fixed axis 132 about which the operating shaft assembly 134 turns is disposed to one vertical side of the gate 50. In the illustrated embodiment, the fixed axis 132 about which the operating shaft assembly 134 turns is disposed above the upper surface 56 of gate 50. In the illustrated embodiment, and to limit confusion for the operator of the gate assembly 30, the operating shaft assembly 104 and 134 of each drive mechanisms 100 and 130, respectively, turn in the same direction relative to each other to effect opening and closing movements of the respective element associated therewith.

To effect these ends, the fixed axis 132 about which operating shaft assembly 130 turns is preferably disposed to the same vertical side of the gate 50 as is operating shaft assembly 104. That is, and like the fixed axis 102 of operating shaft assembly 104 (FIG. 8), the fixed axis 132 about which the operating shaft assembly 130 turns is vertically spaced above the upper surface 56 of the gate 50 (FIG. 15).

Preferably, and as shown in FIG. 15, the operating shaft assembly 134 is of multipiece construction and includes an elongated operating shaft 136 having capstans or operating handles 138, 138' arranged toward opposite ends thereof. In one form, the capstans 138, 138' are releasably connected to opposite ends of the operating shaft 136. In a preferred embodiment, the operating shaft 134 has a square cross-sectional configuration. From an understanding of what follows, however, it will be appreciated other cross-sectional configurations for shaft 136 would equally suffice without detracting or departing from the spirit and scope of this invention disclosure. In the illustrated embodiment, the operating shaft assembly 134 is supported for rotation by the frame extensions 52 and 54 (FIG. 3) of the frame 32.

As shown in FIG. 15, drive mechanism 130 further includes a rack and pinion assembly 140 arranged in operable combination with the operating shaft assembly 134. The purpose of the rack and pinion assembly 140 is to convert rotary movement of operating shaft assembly 134 about axis 132 into linear fore-and-aft movement of the second element or pan assembly 80 relative to the frame 32 depending upon the direction of rotation of operating shaft assembly 134.

The rack and pinion assembly 140 preferably includes a pair of laterally spaced pinions 142 and 142' mounted on and for rotation with the operating shaft 136 of shaft assembly 134. In the embodiment illustrated by way of example, the pinions 142, 142' are identical to each other and, thus, only pinion 142 will be described in detail in connection with FIG. 16. The pinions of drive mechanism 130 are arranged in intermeshing relationship with a pair of racks or toothed tracks 144, 144'. Like pinions 112, 112' (FIG. 11), and as shown in FIG. 16, each pinion of drive mechanism 130 preferably has a centralized throughbore or opening 143. The cross-section of each throughbore 143 is designed to allow the pinions 142, 142' to move, within defined limits, axially along the length of the operating shaft 136. To limit movements of the pinions 142, 142' axially along the length of the operating shaft 136, while eliminating the need for fasteners or the like, each rack 144, 144' is preferably configured with a serpentine design similar to that disclosed in U.S. Pat. No. D427,741 to J. J. Dohr; the applicable portions of which are incorporated herein by reference.

The racks 144, 144' are preferably fastened to and move concomitantly with the second element or pan assembly 80. Returning to FIG. 9, a limit stop 145 is provided in combination with the racks 144, 144' to limit endwise travel or movements of the second element or pan assembly 80 relative to the frame 32 of the gate assembly 30.

Preferably, and when the pan assembly 80 is mounted on the gate assembly 30, the racks 144, 144' extend generally parallel to and outwardly from the opposed side walls 81, 82, respectively, of pan assembly 80. In the embodiment illustrated by way of example, and when the pan assembly 80 is mounted for sliding movements on the frame 32, the racks 144, 144' of each rack and pinion assembly 140 are carried and supported by the frame 32 in laterally spaced outward relation relative to the side walls 81, 82 for movement along a predetermined path. of travel. As such, and in the illustrated embodiment, the racks 144, 144' are disposed outwardly from and to opposed sides of both the discharge opening 34 and the plenum 70 (FIG. 7) defined by gate assembly as to not interfere with the gravitational discharge of material from gate assembly 30.

Suffice it to say, when the second element or pan assembly 80 is in a full open position (when the pinions 142, 142' on operating shaft assembly 134 operably engage with stops 145), the second element or pan assembly 80 is removed from beneath the discharge opening 34 defined by frame 32 so as to permit material in hopper 12 to be gravitationally discharged from hopper 12 through the gate assembly 30.

The gate assembly of the present invention disclosure furthermore includes a lock assembly 150 for influencing movements of both the first and second elements 50 and 80, respectively, along their fixed paths of travel and relative to the frame 32. That is, the purpose of the lock assembly 150 is to releasably hold the first and second elements 50 and 80 of gate assembly 30 against movement toward an open position until the lock assembly 150 is purposefully released by the operator. In the illustrated embodiment, the lock assembly 150 is supported and carried by the gate assembly frame 32 and is automatically operated in response to operation of either the first or second drive mechanism 100 or 130, respectively.

Figure 17:
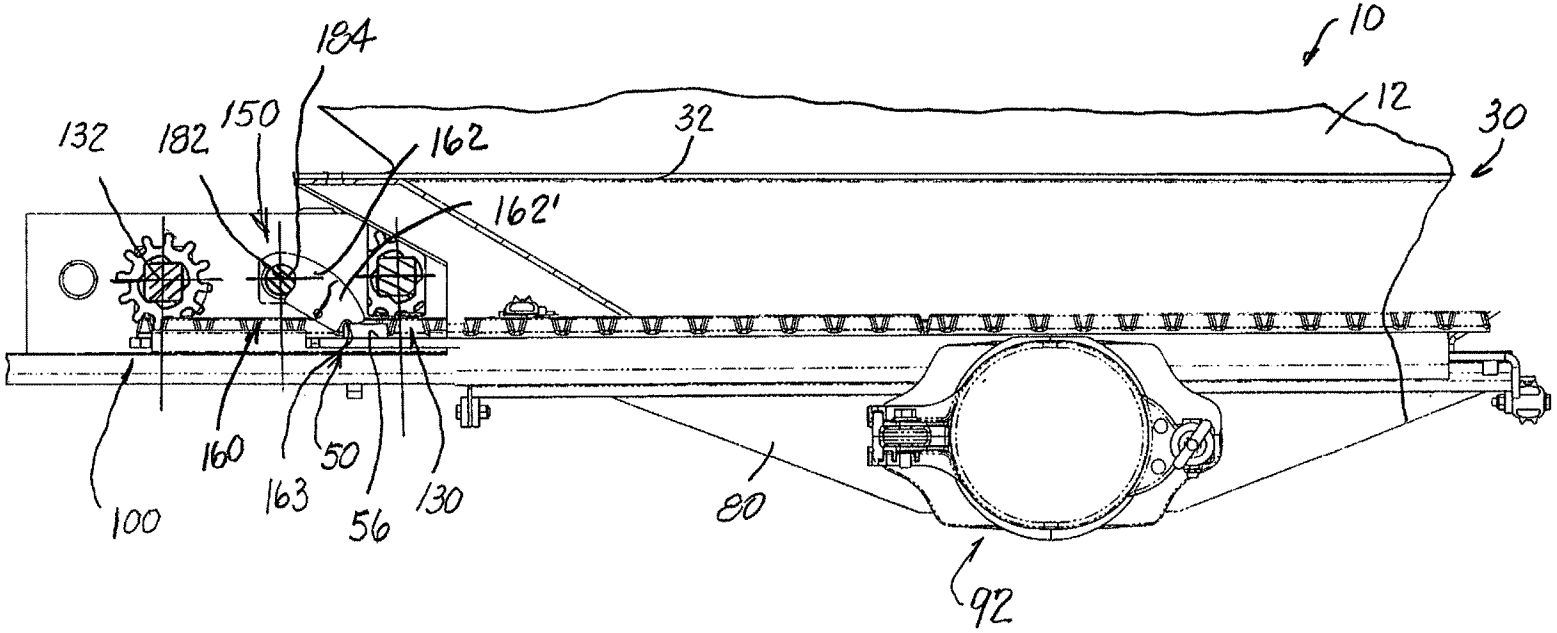
FIG. 17 is a sectional view taken along line 17-17 of FIG. 8 illustrating stops for the first element of the gate assembly in a first position to inhibit inadvertent movement of the first element toward an open position.
Figure 18:
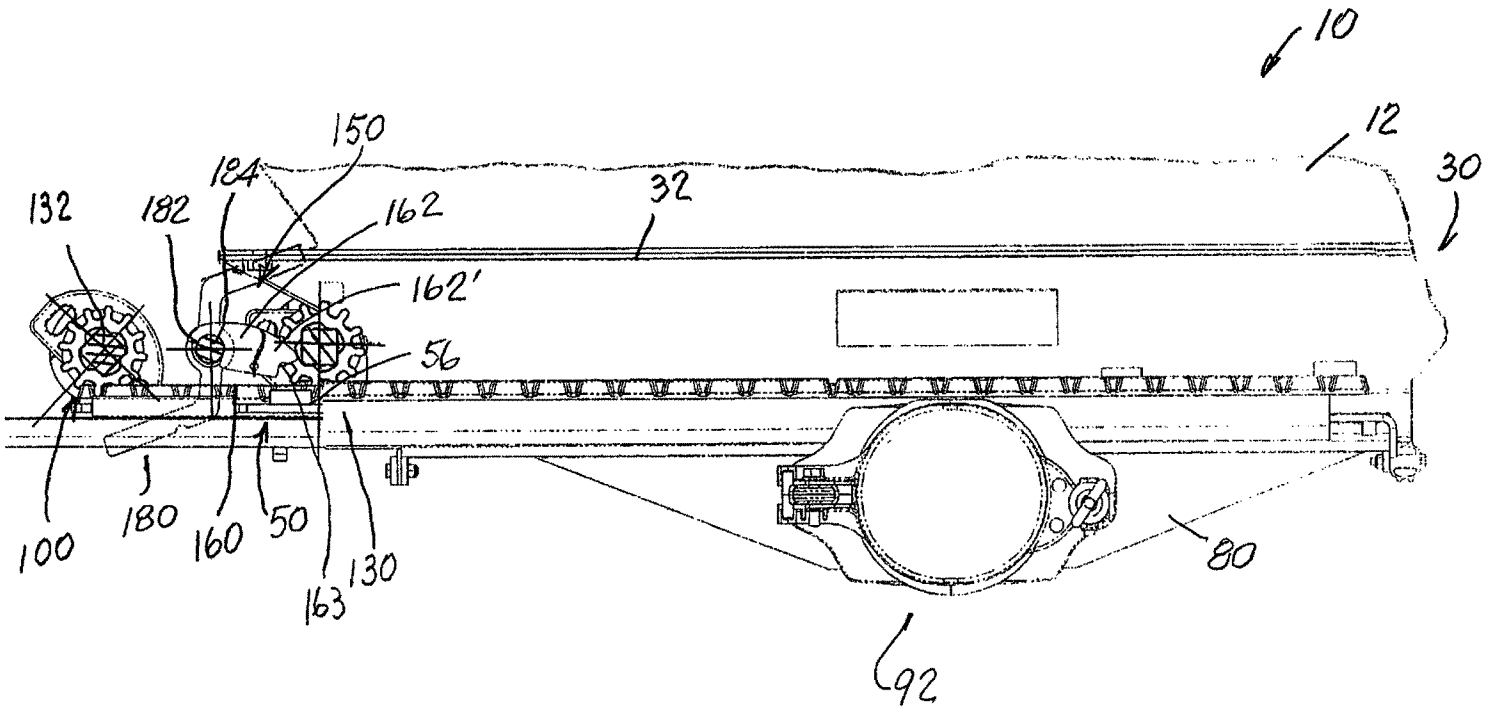
FIG. 18 is a sectional view substantially similar to FIG. 17 but illustrating the stops for the first element of the gate assembly in a released position whereby allowing for movement of the first element toward an open position.

Lock assembly 150 includes a first lock 160 movable between a locked condition, illustrated in FIG. 17, wherein lock 160 releasably maintains the first element or gate 50 in the closed position relative to the frame 32 and the discharge opening 34 defined by the frame 32, and an unlocked condition (FIG. 18). The lock assembly 150 further includes a second lock 170 movable between a locked condition, illustrated in FIG. 19, wherein lock 170 releasably maintains the second element or pan assembly 80 in the closed position relative to the frame 32 and the discharge opening 34 defined by the frame 32, and an unlocked condition (FIG. 20). Moreover, lock assembly 150 includes a mechanism or mechanical system 180 carried on the frame 32 (FIG. 2) for conjointly and positively removing the first and second locks 160 and 170 from their locked condition relative to their respective elements 50 and 80 in timed relation relative to rotation of either drive mechanism 100 and/or 130.

In the illustrated embodiment, lock assembly 150 is preferably configured such that both locks 160 and 170 are initially released in response to operation of either drive mechanism 100 or 130 automatically followed by movement of either the first element 50 or second element 80 of the gate assembly 30 toward the open position. As such, and when the hopper 12 (FIG. 1) is to be unloaded, the operator can be assured, the locks 160 and 170 of lock assembly 150 are released prior to movement of either the first element 50 or second element 80 toward their open position whereby reducing breakage and other inadvertent damages which can result to the elements comprising the lock assembly 150.

In a preferred embodiment shown in FIG. 17, the first lock 160 includes a stop 162 mounted for movement between a first or locked position (FIG. 17) and a second or unlocked position (FIG. 18). In the first position, stop 162 is disposed, at least partially, in the path of movement of the first element or gate 50 to inhibit inadvertent movement of the gate 50 from the closed position toward the open position. In the second position (FIG. 18), stop 162 is removed from the path of movement of the gate 50.

Preferably, the first lock 160 further includes a second stop 162' arranged in laterally spaced relation relative to the first stop 162. Stop 162' is substantially similar to the stop 162 and, thus, no further detailed description need be provided for stop 162'. Suffice it to say, stop 162' is mounted for simultaneous movement with stop 162. That is, stop 162' is mounted for between a first and second positions. In the first position, stop 162' is disposed, at least partially, in the path of movement of the first element or gate 50 to inhibit inadvertent movement of the gate 50 from the closed position toward the open position. In the second position (FIG. 18), stop 162' is removed from the path of movement of the gate 50.

In a preferred form, the second lock 170 includes a stop 172 mounted for movement between a first or locked position (FIG. 19) and a second or unlocked position (FIG. 20). In the first position, stop 172 is disposed, at least partially, in the path of movement of the second element or pan assembly 80 to inhibit inadvertent movement of element 80 from the closed position toward the open position. In the second position (FIG. 20), stop 172 is removed from the path of movement of the second element or pan assembly 80.

Preferably, the second lock 170 further includes as second stop 172' arranged in laterally spaced relation relative to the stop 172. Stop 172' is substantially similar to the stop 172 and, thus, no further detailed description need be provided for stop 172'. Suffice it to say, stop 172' is mounted for simultaneous movement with stop 172. That is, stop 172' is mounted for between a first position (FIG. 19), wherein stop 172' is disposed, at least partially in the path of movement of the second element or pan assembly 80 to inhibit inadvertent movement of element 80 from the closed position toward the open position, and a second position (FIG. 21), wherein stop 172' is removed from the path of movement of the second element or pan assembly 80.

In the illustrated embodiment, the mechanism or mechanical system 180 moves the stops 162, 162' (FIG. 17) between their first and second positions in timed sequential movement relative to movement of the gate 50 toward the open position. Also, the mechanism or mechanical system 180 moves the stops 172, 172' (FIG. 19) between their first and second positions in timed sequential movement relative to movement of element or pan assembly 80 toward the open position.

Figure 20:
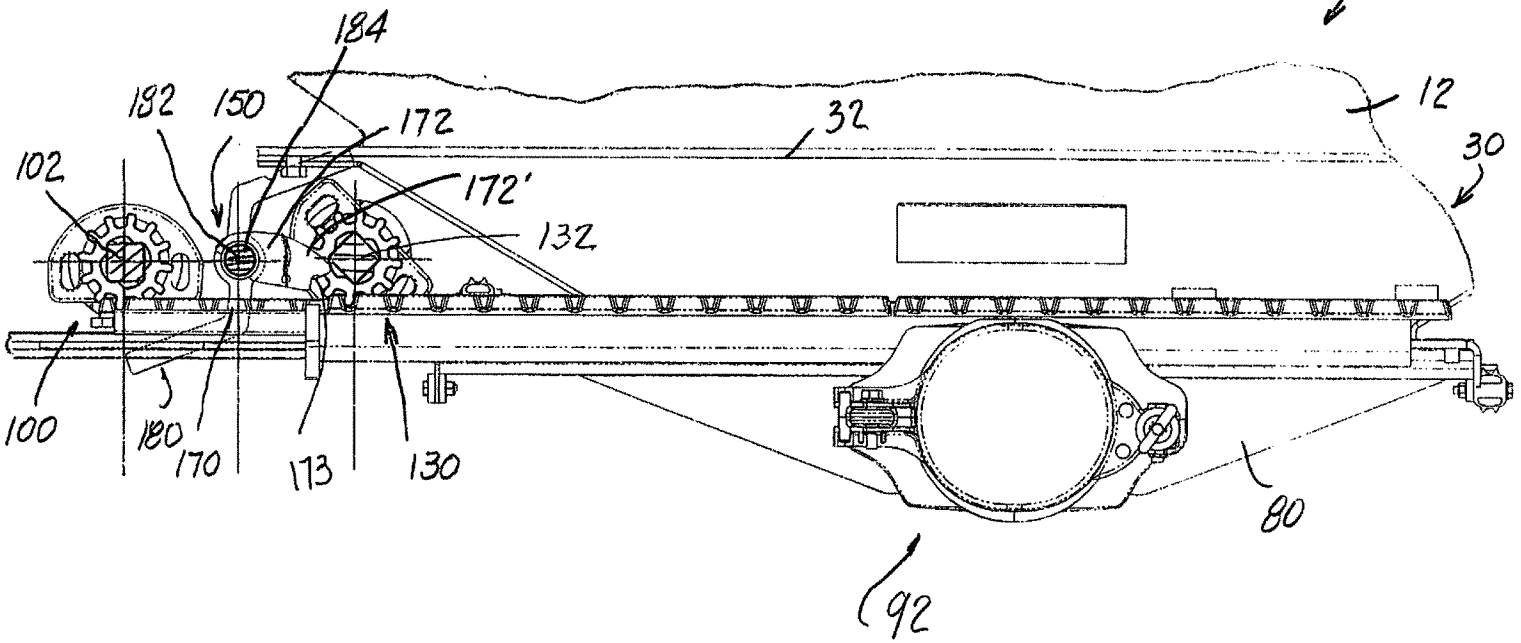
FIG. 20 is a sectional view substantially similar to FIG. 19 but illustrating the stops for the second element of the gate assembly in a released position whereby allowing for movement of the second element toward an open position.
Figure 21:
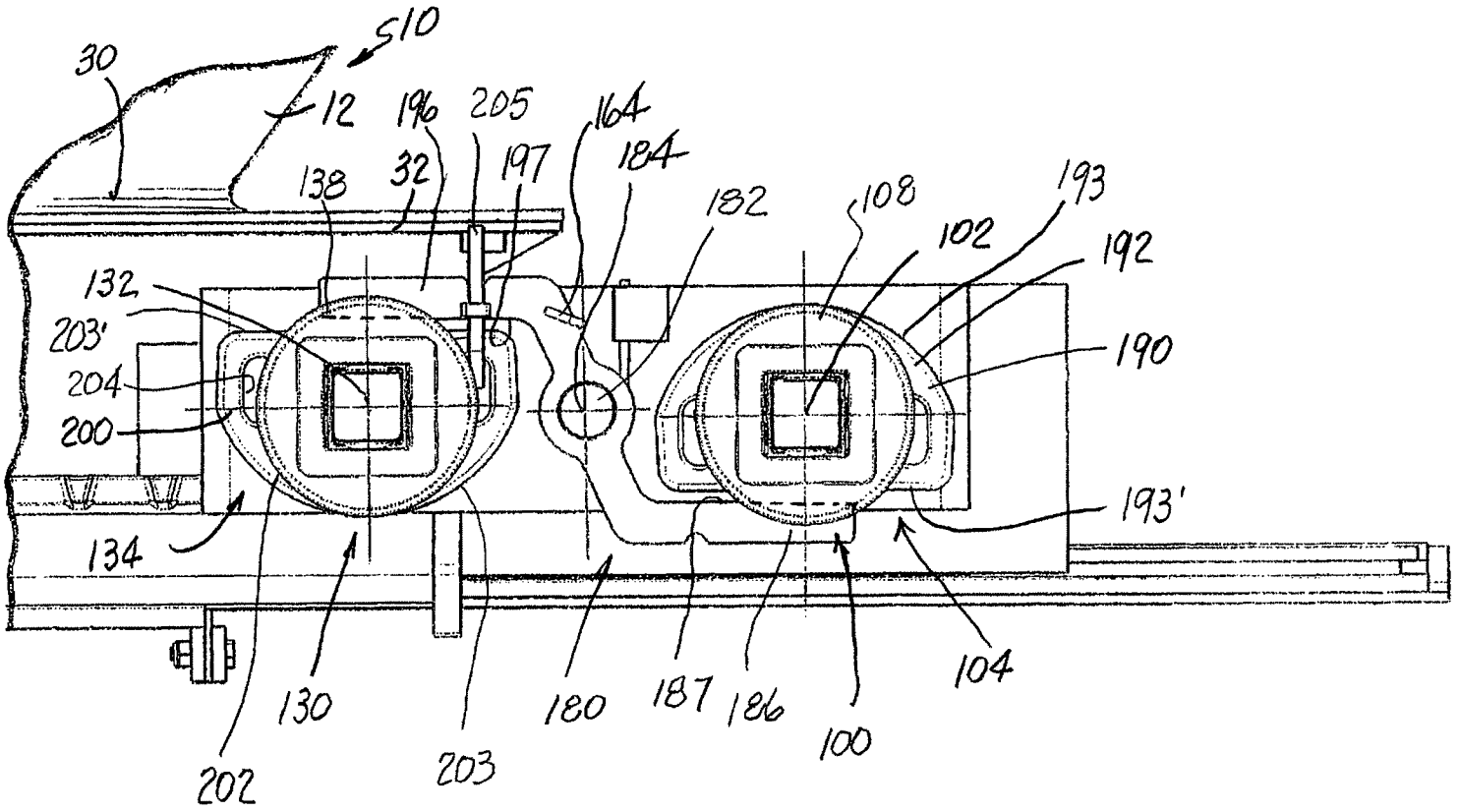
FIG. 21 is an enlarged side elevational view of a lock mechanism forming part of the present invention disclosure.

In the embodiment shown in FIG. 21, a mechanical system 180 is provided on the gate assembly frame 32. As will be appreciated, the mechanical system 180 can take a myriad of different designs for effecting the desired ends without detracting or departing from the true spirt and broad scope of this invention disclosure. In one embodiment, system 180 includes a laterally elongated rock shaft 182 disposed on the frame 32 for rotation about a fixed axis 184 preferably disposed between the first and second fixed axes 102 and 132 of drive mechanisms 100 and 130, respectively. The stops 162, 162' and 172, 172' (FIGS. 17, 18, 19 and 20) are secured for movement with the rock shaft 182.

The shaft 182 of mechanism 180 is preferably arranged above the upper surface 56 of the gate 50 and generally parallel thereto. Shaft 182 is mounted for oscillatory movement about the axis 184 extending generally parallel to axes 102 about which shaft assembly 100 turns and generally parallel to the to axes 132 about which shaft assembly 130 turns.

Preferably, and as shown in FIG. 17, when gate 50 is in a closed position or condition relative to the discharge opening of gate assembly 30, stops 162, 162' depend angularly downward from the rock shaft 182 and a free end of the stops 162, 162' extends toward and into operative engagement with the gate 50. Preferably, the free end of each stop 162, 162' is configured with a notch or recess 163 for operably engaging the gate 50 while limiting angular movement of the stops 162, 162' therepast. Preferably, the operative distance separating the notch 163 from the axis 184 of the rock shaft 182 is greater than the distance separating the axis 184 of the rock shaft 182 from the upper side or surface 56 of gate 50. Accordingly, when the stops 162, 162' operably engage the gate 50, a wedging action is preferably created or established. In a preferred form, the rock shaft 182 is inhibited against axial shifting movements along axis 184 by any suitable means.

Figure 19:
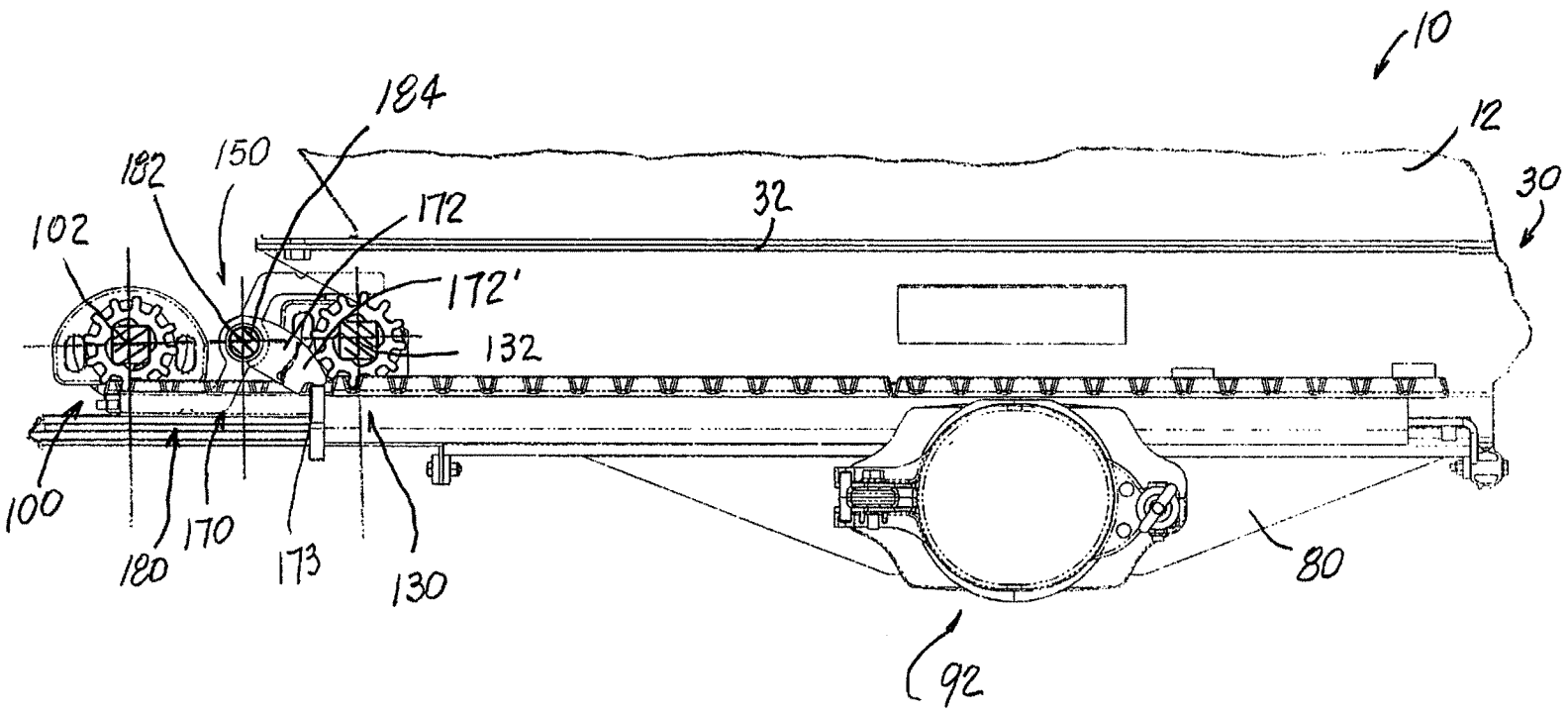
FIG. 19 is a is a sectional view taken along line 19-19 of FIG. 8 illustrating stops for the second element of the gate assembly in a first position to inhibit inadvertent movement of the first element toward an open position.

In the embodiment illustrated by way of example in FIG. 19, when the pan assembly 80 is in a closed position or condition relative to the discharge opening of gate assembly 30, stops 172, 172' depend angularly downward from the rock shaft 182 and a free end of the stops 172, 172' extends toward and into operative engagement with the pan assembly or second element 80. Preferably, the free end of each stop 172, 172' is configured with a notch or recess 173 for operably engaging a portion of the pan assembly or element 80 while limiting angular movement of the stops 172, 172' therepast. Preferably, the operative distance separating the notch 173 from the axis 184 of the rock shaft 182 is greater than the distance separating the axis 184 of the rock shaft 182 from the surface of element 80 operably engaged by each stop 172, 172'. Accordingly, when the stops 172, 172' operably engage with element 80, a wedging action is preferably created or established That embodiment of the mechanical system 180 illustrated by way of example in FIG. 21 for operating the lock assembly 150 in timed sequence with movements of either the gate 50 (FIG. 3) and/or the pan assembly 80 (FIG. 7) preferably includes a one-piece arrangement including a first cam follower 186 radially extending in a first direction relative to axis 184 of rock shaft 182 and a second cam follower 196 radially extending in a second direction, generally opposite the first direction, relative to axis 184 of rock shaft 182. In the illustrated embodiment, the cam followers 186 and 196 extend in directions which are approximately 180 degrees apart from each other.

The first follower 186 of system 180 is adapted to cooperate with cam structure 190 on the operating shaft assembly 104 (FIG. 8) of the first drive mechanism 100 such that the stops 162, 162' of lock 160 (FIGS. 17 and 18) will be positively displaced relative to the path of movement of the first element or gate 50 upon rotation of drive mechanism 100. Similarly, the second follower 196 is adapted to cooperate with cam structure 200 on the operating shaft assembly 134 (FIG. 15) of the second drive mechanism 130 such that the stops 172, 172' of lock 170 (FIGS. 19 and 20) will be positively displaced relative to the path of movement of the second element or pan assembly 80 upon rotation of drive mechanism 130. From the above, it will be understood, that rotation of either drive mechanism 100 and/or 130 will automatically effect operation of the mechanical system 180 whereby releasing either and/or both the stops 162, 162' of lock 160 and stops 172, 172 of lock 170 from their locked condition or position.

Figure 22:
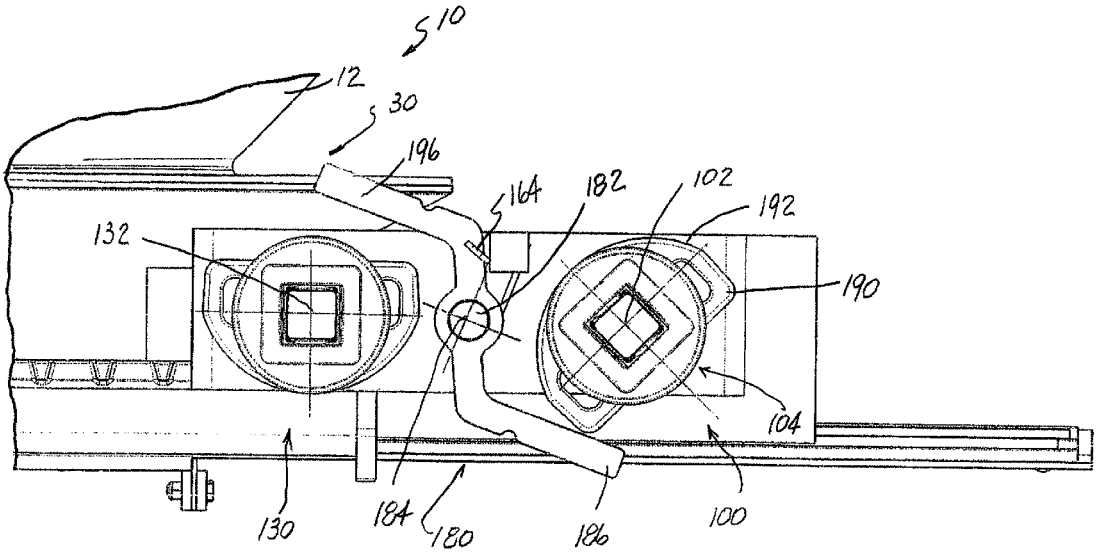
FIG. 22 is a view similar to FIG. 21 but showing the first drive mechanism being rotated to move the first element or gate toward an open position.

In the embodiment shown by way of example in FIG. 22, the cam structure 190 for displacing the stops 162, 162' (FIG. 17) includes an actuating member or cam 192 provided to the side of the gate assembly frame 32 on at least one of the operating handles or capstans 108 of the operating shaft assembly 130. In a preferred form, the cam 192 is provided on the capstan 108. Such design increases the potential throw or movement of the locks 162, 162' (FIGS. 17 and 18) of lock assembly 150 while allowing the cam follower 186 of the mechanical system 180 to be advantageously disposed laterally adjacent to the gate assembly frame 32. Another cam follower and associated cam structure, including an actuating member or cam, which are identical to the cam follower 186 and associated cam structure 190, including an actuating member or cam is preferably provided on the operating handle 108' (FIG. 2) at the other end of the mechanical system 180 on the operating shaft assembly 104.

Since the cam structure 190 at each end of the operating shaft assembly 104 is substantially identical, only one actuating member or cam 192 will be described in detail. Each cam 192 is preferably formed as an integral part of the handle 108 on shaft assembly 104 and includes a peripheral surface 193. Notably, at least a portion of each cam 192 is larger in diameter and extends radially outward from that portion of the operating handle 108 preferably joined thereto. In the embodiment illustrated by way of example in FIG. 21, the peripheral surface 193 of each cam 192 includes a generally flat surface 193'. Along its underside, each cam follower 186 includes a cam engaging surface 187 specifically configured to inhibit the follower 186 from binding against the peripheral surface 193 of the cam 192.

Besides being gravitationally urged into engagement with the gate 50, in a preferred embodiment, stops 162, 162' are urged into positive engagement with the gate 50 so as to inhibit inadvertent release of the lock assembly 150 as the railcar travels between locations. In the form shown in FIG. 21, shaft 182 of the mechanical system 180 is resiliently biased by a suitable torsion spring 164 operably engagable between the gate assembly frame 32 and a leg of the cam follower 186 to resiliently urge stops 162, 162' toward their first or locked position, thus, preventing stops 162, 162' from inadvertent disengagement from gate 50. The preferred spring arrangement 164 furthermore allows the follower 186 to advantageously remain in operative engagement with the periphery 193 of the cam structure 190 during turning rotational movements of the operating shaft assembly 104.

In the embodiment shown by way of example in FIG. 21, the cam structure 200 for displacing the stops 172, 172' (FIG. 19) of the second lock 170 includes an actuating member or cam 202 provided to the side of the gate assembly frame 32 on at least one of the operating handles or capstans 138 of the operating shaft assembly 134. In this arrangement, cam structures 190 and 200 are arranged out of phase relative to each other. That is, the cam structures 190 and 200 are arranged 180 degrees out of phase relative to each other.

In a preferred form, cam 202 is provided on the capstan 138. Such design allows the cam follower 196 of the mechanical system 180 to be advantageously disposed adjacent to the gate assembly frame 32. Preferably, another cam follower and associated cam structure, including an actuating member or cam, which are identical to the cam follower 196 and associated cam structure 200, including an actuating member or cam 202 is preferably provided on the operating handle 138' (FIG. 4) at the other end of the mechanical system 180 on the operating shaft assembly 104.

Since the cam structure at each end of the operating shaft assembly 134 (FIG. 4) is substantially identical, only one actuating member or cam 202 will be described in detail. As shown in FIG. 21, each cam 202 is preferably formed as an integral part of the handle 138 on shaft assembly 134 and includes a peripheral surface 203. Notably, at least a portion of each cam 202 is larger in diameter and extends radially outward from that portion of the operating handle 138 preferably joined thereto. In the embodiment illustrated by way of example in FIG. 21, the peripheral surface 203 of each cam 202 includes a generally flat surface 203' which is disposed 180 degrees out of phase relative to the flat surface 193' on cam 192. Along its underside, the cam follower 196 includes a cam engaging surface 197 specifically configured to inhibit the follower 196 from binding against the peripheral surface 203 of the cam 202.

Besides being gravitationally urged into operative engagement with at least a portion of the pan assembly 80, in a preferred embodiment, stops 172, 172' are urged into positive operative engagement with a portion of the pan assembly 80 so as to inhibit inadvertent release of the stops 172, 172' as the railcar travels between locations. As mentioned, shaft 182 of the mechanical system 180 is resiliently biased by the torsion spring 164. As such, and since the stops 172, 172' move with the shaft 182 they too are resiliently urged toward the first position, thus, preventing stops 172, 172' from inadvertent operative disengagement with the second element or pan assembly 80. The preferred spring arrangement furthermore allows the follower 196 to advantageously remain in operative engagement with the periphery 203 of the cam structure 200 during turning rotational movements of the operating shaft assembly 134.

In the embodiment shown, each actuating member or cam 202 defines a throughbore or slot 204, having a closed margin, arranged in radially spaced relation relative to the rotational axis 132 of the operating shaft assembly 134. Moreover, the cam follower 189 is preferably configured to promote arrangement of a tamper seal 205 (FIG. 21) in only one position of the lock assembly 150 (FIGS. 17, 18, 19 and 20). In the embodiment shown in FIG. 21, the tamper seal 205 comprises a ribbon-like member adapted to be passed through the throughbore or slot 204 in the cam 202 and about the cam follower 189, with opposite ends of the seal 205 being operably joined to each other to provide a visual indication of railcar tampering. Of course, a similar arrangement for a tamper seal can be provided in operable combination with cam structure 190 without detracting or departing from the spirit and scope of this invention disclosure.

Preferably, the mechanical system for operating the lock assembly 150 includes a lost motion mechanism 210 (FIG. 11) operably disposed between operating shaft assembly 104 and the first lock 160 (FIGS. 17 and 18) in a manner effecting sequential movement of the stops 162, 162' and the first element or gate 50 in predetermined relation relative to each other. Preferably, the mechanical system 180 for operating the lock assembly 150 furthermore includes a second lost motion mechanism 250 (FIG. 16) operably disposed between operating shaft assembly 134 and the second lock 170 (FIGS. 19 and 20) in a manner effecting sequential movement of the stops 172, 172' and the second element or pan assembly 80 in predetermined relation relative to each other. The purpose of each lost motion mechanism is to permit the respective operating shaft assembly to rotate about an angle of free rotation without corresponding movement of respective element associated therewith. As used herein, the term "free rotation" refers to that rotation of the respective operating shaft assembly suitable to unlatch the stops from their respective elements prior to effecting displacement of either element toward an open position.

As will be appreciated, the lost motion mechanism 210 can take different designs without detracting or departing from the spirit and scope of this invention disclosure. In the embodiment illustrated by way of example, shaft 106 of operating shaft assembly 104 has a generally square cross-sectional configuration. Moreover, in the embodiment shown in FIG. 11, the pinions of drive mechanism 100 each define a slip socket or slotted configuration 125 specifically related to the cross-sectional configuration of and through which shaft 106 of shaft assembly 104 endwise passes. The slip socket configuration 125 in each pinion has a duodecimal surface configuration preferably centered about the axis 102 of operating shaft assembly 104 and defines a rotary path for the operating shaft 106 relative to each pinion of drive mechanism 100 (FIG. 21). Without incurring serious redesign, an alternative version of the lost motion mechanism 210 can be incorporated into the operating handles or capstans 108, 108' of the operating shaft assembly 104.

Figure 11A:
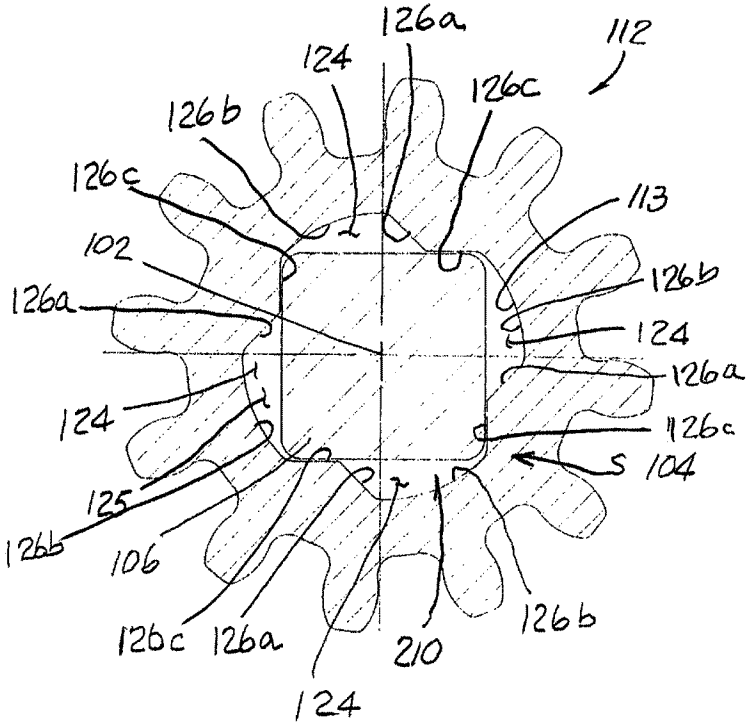
FIG. 11A is a view substantially similar to FIG. 11 but showing the operating shaft of the first drive mechanism being rotated through a range of free rotation.
Figure 11:
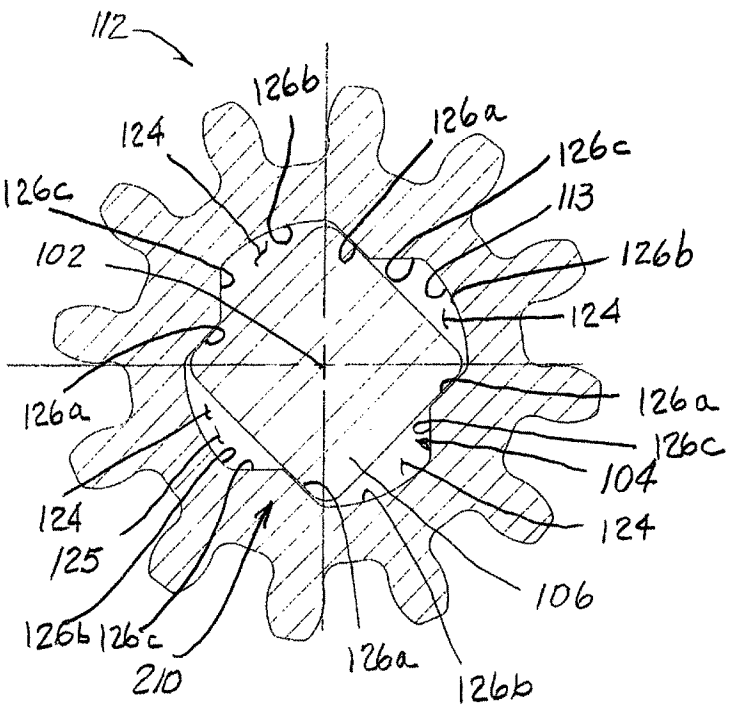
FIG. 11 is an enlarged sectional view of a pinion forming part of a drive mechanism for moving the first element or gate between open and closed positions.

In the embodiment shown by way of example in FIG. 11, and because shaft 106 has a square cross-sectional configuration, the slotted configuration in each pinion of drive mechanism 100 includes four equally spaced recesses 124 joined to each other and equally disposed about axis 102 of operating shaft assembly 104. The recesses 124 in each pinion combine with each other such that each pinion defines the slip socket 125. As shown in FIG. 11, each recess 124 includes first, second, and third walls or surfaces **126*a*, 126*b* and 126*c*, respectively. Each wall or surface defined by each recess 124 defines the limit of rotation of shaft 106. The wall or surface 126*b* of each recess 124 has a curvilinear configuration and a radius equal to one-half the distance between diametrically opposed corners on shaft 106. As will be appreciated by comparing FIGS. 11 and 11A, the angular offset between the walls or surfaces 126*a* and 126*c* limits the free rotational movement of the operating shaft assembly 104. As will be appreciated, if the cross-sectional configuration of shaft 106 were other than square, the configuration of the slip socket 125 defined by the recesses 124 in the pinions of mechanism 100 can be altered to accommodate a predetermined angle of free rotation of the operating shaft assembly 104**.

As with the lost motion mechanism 210 illustrated by way of example in FIG. 11, the lost motion mechanism 250 (FIG. 16) can take different designs without detracting or departing from the spirit and scope of this invention disclosure. In the embodiment illustrated by way of example in FIG. 16, shaft 136 of operating shaft assembly 134 has a generally square cross-sectional configuration. Moreover, in the embodiment shown, the pinions of the second drive mechanism 130 each define a slip socket or slotted configuration 145 specifically related to the cross-sectional configuration of and through which the shaft 136 of shaft assembly 134 endwise passes. The slip socket configuration 145 in each pinion of mechanism 130 has a duodecimal surface configuration preferably centered about the axis 132 of operating shaft assembly 134 and defines a rotary path for the operating shaft 136 relative to each pinion of the second drive mechanism 130. Without incurring serious redesign, an alternative version of the lost motion mechanism 250 can be incorporated into the operating handles or capstans 138, 138' of the operating shaft assembly 134.

In the embodiment illustrated by way of example in FIG. 16, and because shaft 136 has a square cross-sectional configuration, the slotted configuration in each pinion 142, 142' includes four equally spaced recesses 147 joined to each other and equally disposed about axis 132 of operating shaft assembly 134. The four recesses 147 in each pinion combine with each other such that each pinion defines the slip socket 145. As shown in FIG. 16, each recess 147 includes first, second, and third walls or surfaces 148*a*, 148*b* and 148*c*, respectively. Each wall or surface defined by recess 147 defines the limit of rotation of shaft 134. The wall or surface 148*b* of each recess 147 has a curvilinear configuration and a radius equal to one-half the distance between diametrically opposed corners on shaft 136. As will be appreciated by comparing FIGS. 16 and 16A, the angular offset between the walls or surfaces 148*a* and 148*c* of each recess limits the free rotational movement of the operating shaft assembly 134. If the cross-sectional configuration of shaft 136 were other than square, the configuration of the slip socket 145 defined by the recesses 147 in the pinions on operating shaft assembly 134 can be altered to accommodate a predetermined angle of free rotation of the operating shaft assembly 134.

Operation of the gate 50 and the first lock 150 is such that when gate 50 is in a closed position, each stop 162, 162' is in operative engagement with gate 50 (FIG. 17) and shaft 106 of shaft assembly 104 is disposed relative to the slip pinions 112 substantially as shown in FIG. 11. Gate 50 is locked in its closed position, at this time. With the gate 50 closed, the outer surface of shaft 106 extends generally parallel to and likely engages the walls or surfaces 126*a* of each slip socket or recess 125 of each slip pinion 112 on the operating shaft assembly 104. As discussed above, in the closed position, gate 50 is supported relative to the discharge opening 34 by the support structure 60 (FIG. 3) extending across the discharge opening 34 beneath gate 50.

When gate 50 of gate assembly 30 is to be opened, a suitable tool or powered driver (not shown) operably engages with either capstan 108, 108' and is operated to turn or rotate the operating shaft assembly 104 in the appropriate direction. In the embodiment illustrated in FIG. 22, shaft assembly 104 is turned in a counterclockwise direction to open the gate 50. As will be appreciated, rotation of shaft assembly 104 imparts rotation to shaft 106 (FIG. 8) along with the operating handles or capstans 108, 108' interconnected by shaft 106. Turning shaft assembly 104 also causes rotation of the cam structure 190 while also resulting in breakage of the tamper seal 205 (FIG. 21).

As shown in FIG. 22, during initial rotation of shaft assembly 104, the cam structure 190 actuates the mechanical system 180. That is, initial rotational movement of the shaft assembly 104 forcibly and positively displaces the cam follower 186 against the action of spring 164 (FIGS. 21 and 22) resulting in clockwise rotation of the rockshaft 182 about axis 184. As shown in FIG. 18, rotation of the rockshaft 182 about axis 184 effects displacement and removal of the stops 162, 162' from the predetermined path of travel of the gate 50.

Returning to FIG. 11A, during initial rotation of the operating shaft assembly 104 in a direction to move the gate 50 toward an open position, shaft 106 traverses the radial space between surfaces 126*a* and 126*c* in the slotted recesses 124 of each slip pinion on operating shaft assembly 104 and no linear movement is imparted to the gate 50. That is, during initial rotational movement of the operating shaft assembly 104 in a direction to move the gate 50 toward an open position, operating shaft assembly 104 turns through a range of free angular movement ranging between about 35 degrees and about 55 degrees without any corresponding linear movement of the gate 50 toward an open position. In a most preferred form, the shaft assembly 104 turns through a range of free angular movement of about 45 degrees. It is through this range of free angular movement of the operating shaft assembly 104 that the mechanism or mechanical system 180 unlatches/unlocks the locks 162, 162' of lock assembly 150 from operable engagement with gate 50.

At the limit of free rotational movement of operating shaft assembly 104, shaft 106 is disposed as shown in FIG. 11A within the slip socket 125 of each pinion. In such position, the outer surfaces on shaft 106 extend generally parallel with and likely engages the third wall or surface 126*c* of each recess 124 of each pinion 112.

Rotation of operating shaft assembly 104 in a direction to move the gate 50 toward the open position causes cam structure 190 to move the stops 162, 162' against the action of spring 164 (FIG. 21) while concomitantly resulting in rotation of the pinions 112 and linear displacement of the gate 50 toward an open position. That is, once the lost motion mechanism 210 collapses as a result of shaft 106 traversing the distance separating radial surfaces 126*a* and 126*c* (FIG. 11A) on the slip pinions, the pinions are thereafter operably coupled to the shaft 106 resulting in linear displacement of the gate 50 toward the open position. After the locks 162, 162' of lock assembly 150 are unlatched or released from the operable engagement with gate 50, the cam structure 190 (FIG. 22) is configured such that the stops 162, 162' (FIG. 18) are positioned and maintained out of engagement with the gate 50 until gate 50 is returned to the closed position.

As will be appreciated from an understanding of that set forth above, the present invention disclosure permits either gravitational discharge or pneumatic discharge of commodity or material from the hopper 12 (FIG. 1). After the gate 50 is opened, material/commodity in hopper 12 (FIG. 1) gravitationally falls through the discharge opening 34 and toward the second element or pan assembly 80. Depending upon the disposition of the second element or pan assembly 80, the commodity can be either gravitationally or pneumatically discharged.

When second element or pan assembly 80 of gate assembly 30 is to be opened, to effect gravitational discharge of material/commodity from gate assembly 30, a suitable tool or powered driver (not shown) operably engages with either capstan 138, 138' and is operated to turn or rotate the operating shaft assembly 134 in the appropriate direction. In the embodiment illustrated in FIG. 23, shaft assembly 134 is turned in a counterclockwise direction to open the second element 80. As will be appreciated, rotation of shaft assembly 134 imparts rotation to the shaft 136 (FIG. 15) along with the operating handles or capstans 138, 138' interconnected by shaft 136. Turning shaft assembly 134 also causes rotation of the cam structure 200.

Figure 23:
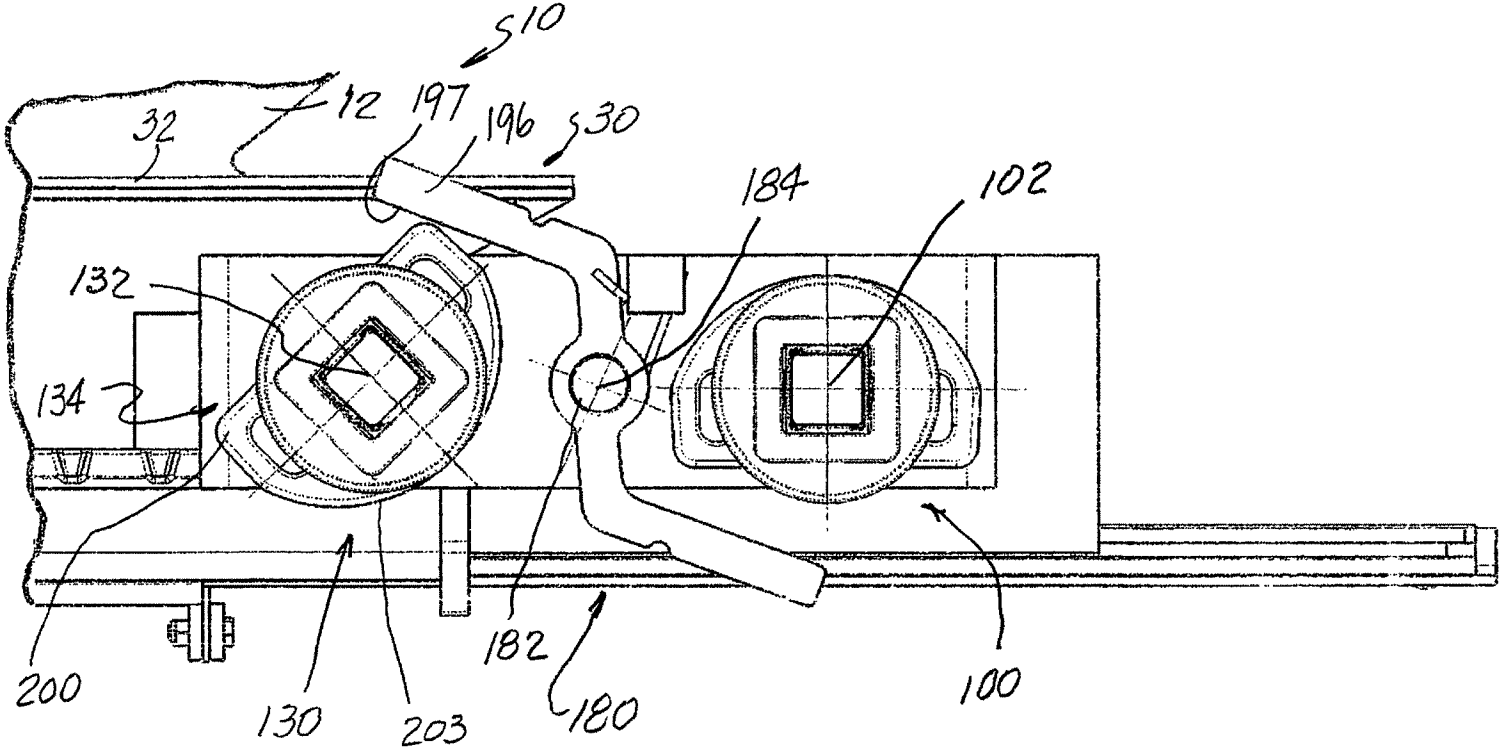
FIG. 23 is a another view similar to FIG. 21 but showing the second drive mechanism being rotated to move the second element or pan assembly toward an open position.

During initial rotation of shaft assembly 134, and as shown in FIG. 23, the cam structure 200 actuates the mechanical system 180. That is, initial rotational movement of the shaft assembly 134 forcibly and positively displaces the cam follower 196 resulting in clockwise rotation of the rockshaft 182 about axis 184 as shown in FIG. 23. As will be appreciated from the above, rotation of the rock shaft 182 about axis 184 concurrently effects removal of the stops 162, 162' from the path of travel of gate 50 as well as effecting displacement and removal the stops 172, 172' of lock 170 from the predetermined path of travel of the second element 80.

Figure 16A:
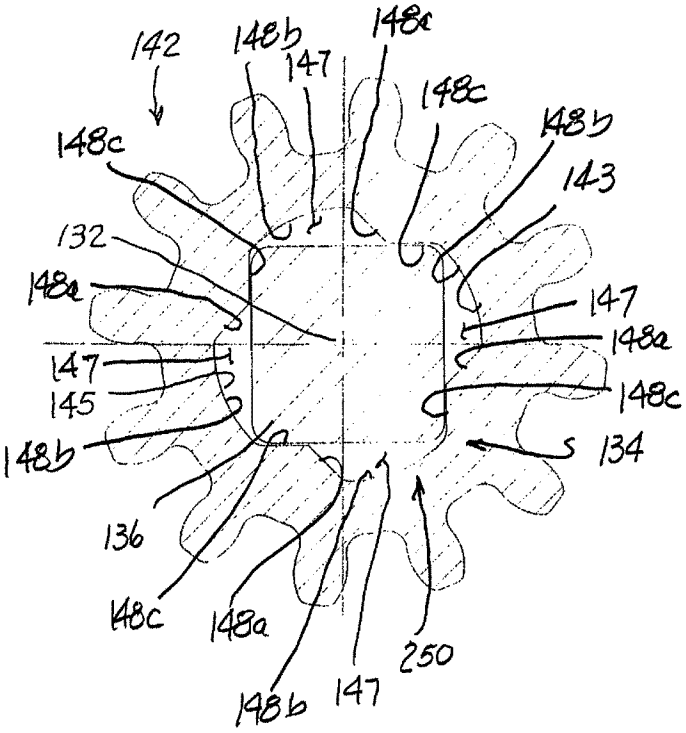
FIG. 16A is a view substantially similar to FIG. 16 but showing the operating shaft of the second drive mechanism being rotated through a range of free rotation.
Figure 16:
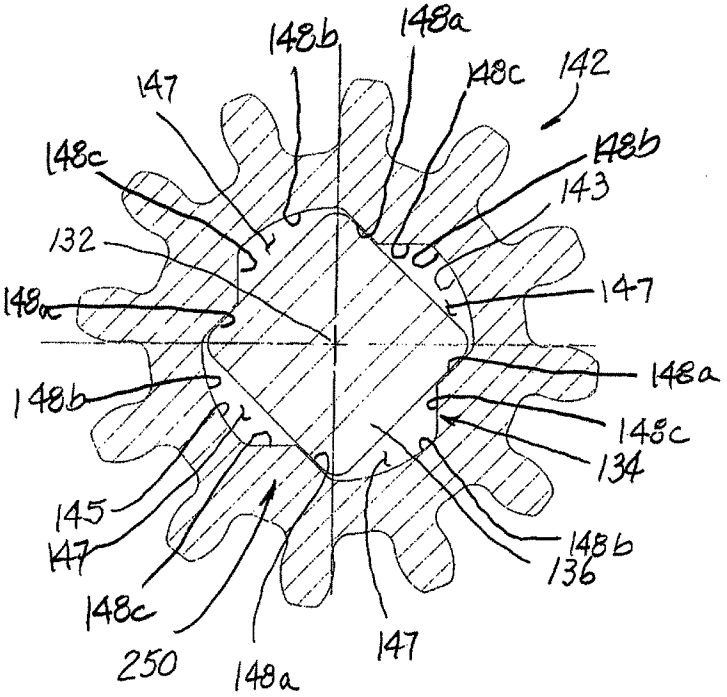
FIG. 16 is an enlarged sectional view of pinion forming part of a drive mechanism for moving the second element or pan assembly between open and closed positions.

As shown in FIG. 16A, during initial rotation of the operating shaft assembly 134 in a direction to move the second element or pan assembly 80 toward an open position, shaft 136 traverses the radial space between surfaces 148*a* and 148*c* in the slotted recesses 147 of each slip pinion on operating shaft assembly 134 and no linear movement is imparted to the second element or pan assembly 80. That is, during initial rotational movement of the operating shaft assembly 134 in a direction to move the second element or pan assembly 80 toward an open position, the operating shaft assembly 134 turns through a range of free angular movement ranging between about 35 degrees and about 55 degrees without any corresponding linear movement of element 80 toward an open position. In a most preferred form, the shaft assembly 134 turns through a range of free angular movement of about 45 degrees. It is through this range of free angular movement of the operating shaft assembly 134 that the mechanism or mechanical system 180 unlatches/unlocks the stops 172, 172' of the second lock 170 from operable engagement with the second element or pan assembly 80.

At the limit of free rotational movement of operating shaft assembly 134, shaft 136 is disposed as shown in FIG. 16A within the slip socket 145 of each pinion of drive mechanism 130. In such position, the outer surfaces on shaft 136 extend generally parallel with and likely engage the third wall or surface 148*c* of each slip socket 145 of each pinion.

As shown in FIG. 16A, continued rotation of operating shaft assembly 134 in a direction to move the element 80 toward the open position causes the cam structure 200 through the rock shaft 182 and second cam follower 196 to further displace or move the stops 172, 172' while concomitantly resulting in rotation of the pinions and linear displacement of the element 80 toward an open position. That is, once the lost motion mechanism 250 collapses as a result of shaft 136 traversing the distance separating radial surfaces 148*a* and 148*c* (FIG. 16A) on the slip pinions, the pinions are thereafter operably coupled to the shaft 136 resulting in linear displacement of element 80 toward the open position. After the locks 172, 172' of the second lock 170 are unlatched or released from the operable engagement with element 80, the cam structure 200 (FIGS. 17 and 18) is configured such that the stops 172, 172' are positioned and maintained out of engagement with the element 80 until element 80 is returned to the closed position.

After the commodity is gravitationally discharged from car 10, the operating shaft assembly 104 is rotated to return the first element or gate 50 to a closed position. When the operating shaft assembly 104 is rotated to close the first element or gate, shaft 106 initially traverses the angular or radial distance separating walls or surfaces 126*c* and 126*a* within the slotted recesses 124 on the pinions on shaft assembly 104 until the outer surface of shaft 106 engages with walls or surface 126*a* within the slotted recesses 124 on the pinions on shaft assembly 104. Continued rotation of the operating shaft assembly 106 imparts rotation to the pinions of mechanism 100 which is transmuted to linear displacement of the gate 50 toward the closed position by the rack and pinion assembly 110. When the gate 50 reaches the closed position, the cam structure 190 is disposed as shown in FIG. 21. Accordingly, the effects of gravity and the influence of the spring 164 (FIG. 21) urge the stops 162, 162' of the first lock 160 into the position shown in FIG. 17 whereby again releasably locking the gate 50 in the closed position or condition.

Similarly, and after the commodity is discharged from car 10, the operating shaft assembly 134 is rotated to return element or pan assembly 80 to a closed position. When the operating shaft assembly 134 is rotated to close element 80, shaft 136 initially traverses the angular or radial distance separating walls or surfaces 148*c* and 148*a* within the slotted recesses 147 on the pinions of mechanism 130 until the outer surface of shaft 136 engages with walls or surface 148*a* within the slotted recesses 147 on the pinions. Continued rotation of the operating shaft assembly 134 imparts rotation to the pinions which is transmuted to linear displacement of the element 80 toward the closed position by the rack and pinion assembly 140. When element 80 reaches the closed position, the cam structure 200 is disposed as shown in FIG. 21.

According to another aspect of this invention disclosure, there is provided a method for controlling discharge of material through an opening defined by a railroad hopper car 10. The method includes the steps of: providing a frame 32 configured for attachment to the hopper car 12 and defining a discharge opening 34 arranged in general registry with the opening 22 defined by the hopper car 10. The frame 32 includes a pair of side walls 36, 38 extending generally parallel to a longitudinal axis 11 of car 10 and a pair of end walls 40, 42 rigidly interconnected to the side walls 36, 38. Another step involves: providing a unitary first element 50 carried by the frame 32 for sliding movements in a single generally horizontal path of travel and relative to the discharge opening 34 between closed and open positions. Another step in the methodology involves: providing a second element 80 carried by the frame 32 beneath the first element 50 for sliding movements in a single generally horizontal path of travel and relative to the discharge opening 34 between closed and open positions. Another step involves: providing a first drive mechanism 100 on the frame 32 for rotation about a first fixed axis 102 for moving the first element 50 relative to the frame. Another step involves: providing a second drive mechanism 130 on the frame 32 for rotation about a second fixed axis 132 for moving the second element 80 relative to the frame 32, with the second axis 132 extending generally parallel to the first axis 102. Another step involves: arranging a lock assembly 150 on the frame 32 between the first and second drive mechanisms 100 and 130, respectively. The lock assembly 150 includes a first lock 150 movable between a locked condition, wherein the first lock 150 extends into the path of travel of the first element 50 when the first element 50 is in the closed position whereby releasably maintaining the first element 50 in the closed position, and an unlocked condition, and a second lock 170. The second lock 170 is movable between a locked condition, wherein the second lock 170 operably extends into the path of travel of the second element 80 when the second element 80 is in the closed position whereby releasably maintaining the second element 80 in the closed position, and an unlocked condition. Another step involves providing a mechanism 180 for conjointly and positively removing the first and second locks 150 and 170, respectively, from the path of travel of their respective element upon rotation of either drive mechanism 100, 130.

In one form, the method for controlling discharge of material through the opening 22 defined by the railroad hopper car 10 includes the step of: providing a rack and pinion assembly 110 and 140 in operable combination with the first and second elements 50 and 80, respectively, of the gate assembly 30. Each rack and pinion assembly 110, 140 includes a pair of racks 114, 144 operably associated with a respective element, and with the racks 114, 144 associated with each element being movable along a predetermined path of travel concomitantly with the respective element 50, 80. Preferably, the method for controlling discharge of material through the opening 22 defined by the railroad hopper car 10 includes the further step of: arranging a centerline 102 and 132 of the first and second drive mechanisms 100 and 130, respectively, to a common vertical side of the predetermined path of travel of the respective racks 114, 144 of each rack and pinion assembly 110, 140.

In one form, the method for controlling discharge of material through the opening 22 defined by the railroad hopper car 10 includes the further step of: supporting the racks 114 operably associated with the first element 50 on a pair of laterally spaced extensions 51, 51' on the first element 50 which are slidably carried on the frame 32. Each extension 51, 51' is laterally disposed outwardly of the side walls of the frame and move with the first element 50.

Preferably, the method for controlling discharge of material through the opening 22 defined by the railroad hopper car 10 furthermore involves the step of: providing a non-metallic material 116, 116' between an underside of each lateral extension 51, 51' on the first element 50 and the frame 32 for operably reducing the coefficient of friction therebetween as the first element 50 is moved between closed and open positions relative to the discharge opening 34 defined by the frame 50.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A discharge gate assembly for a railroad hopper car, said discharge gate assembly comprising:

a rigid frame defining a discharge opening;

a first element carried by said frame for movement between a closed position, wherein said first element extends across said discharge opening, and an open position;

a second element carried by said frame for movement between a closed position, wherein said second element extends across said discharge opening, and an open position, with said first and second elements being arranged on said frame in vertically spaced relation relative to each other;

a first drive mechanism including a first operating shaft assembly mounted on said frame for moving said first element relative to said frame;

a second drive mechanism including a second operating shaft assembly mounted on said frame for moving said second element relative to said frame;

a lock assembly carried by said frame, said lock assembly including a first lock movable between a locked condition, wherein said first lock releasably maintains said first element in said closed position, and an unlocked condition, a second lock movable between a locked condition, wherein said second lock releasably maintains said second element in said closed position, and an unlocked condition; and a mechanism for positively removing said first and second locks from their locked condition relative to their respective elements upon rotation of either one of said first and second drive mechanisms.

2. The discharge gate assembly according to claim 1, wherein each drive mechanism includes a lost motion connection for allowing the respective drive mechanism to be rotated a predetermined number of degrees during collapse of the lost motion connection before contributing to significant movement of the respective element relative to said frame.

3. The discharge gate assembly according to claim 1, wherein said first and second drive mechanisms each include a rack and pinion assembly arranged in operable combination with the operating shaft assembly of the respective drive mechanism.

4. The discharge gate assembly according to claim 3, wherein each rack and pinion assembly includes a rack operably associated with a respective element, and with each rack being movable along a predetermined path of travel concomitantly with the respective element.

5. The discharge gate assembly according to claim 4, wherein a centerline of each operating shaft assembly is disposed to a common vertical side of the of the predetermined path of travel of the respective rack of each rack and pinion assembly.

6. The discharge gate assembly according to claim 1, wherein said first element is a discharge gate slidably movable along a generally horizontal path of travel relative to said frame, with said discharge gate having an upper surface and a lower surface.

7. The discharge gate assembly according to claim 6, further including support structure disposed beneath the lower surface of said gate and above said second element.

8. The discharge gate assembly according to claim 1, wherein said second element is a pan assembly slidably movable along a generally horizontal path of travel relative to said frame, with said pan assembly defining a pneumatic discharge outlet.

9. The discharge gate assembly according to claim 1, wherein each operating shaft assembly includes cam structure for positively removing said locks from their locked condition relative to their respective element upon rotation of either of said drive mechanisms.

10. The discharge gate assembly according to claim 9, wherein the cam structure on said first and second operating shaft assemblies are arranged a predetermined number of degrees out of phase relative to each other.

11. The discharge gate assembly according to claim 1, wherein each operating shaft assembly includes an operating shaft rotatably supported on said frame and capstans removably connected to opposite ends of said operating shaft.

12. The discharge gate assembly according to claim 11, wherein the cam structure of each operating shaft assembly is provided on each capstan.

13. A discharge gate assembly for a railroad hopper car, said discharge gate assembly comprising:

a frame configured for attachment to said hopper car and defining a discharge opening, said frame including a pair of side walls extending generally parallel to a longitudinal axis of the hopper car and a pair of end walls rigidly interconnected to said side walls;

a first element carried by said frame for sliding movements in a single generally horizontal path of travel and relative to said discharge opening between closed and open positions;

a second element carried by said frame beneath said first element for sliding movements in a single generally horizontal path of travel and relative to said discharge opening between closed and open positions;

a first drive mechanism including a first operating shaft assembly mounted on said frame for rotation about a first axis fixed relative to said frame for moving said first element relative to said frame;

a second drive mechanism including a second operating shaft assembly mounted on said frame for rotation about a second axis fixed relative to said frame for moving said second element relative to said frame;

a lock assembly carried by said frame and including a first lock movable between a locked condition, wherein said first lock extends into the path of travel of said first element when said first element is in the closed position whereby releasably maintaining said first element in said closed position, and an unlocked condition, a second lock movable between a locked condition, wherein said second lock operably extends into the path of travel of said second element when said second element is in the closed position whereby releasably maintaining said second element in said closed position, and an unlocked condition; and a mechanism for conjointly and positively removing said first and second locks from the path of travel of their respective elements upon rotation of either one of said first and second drive mechanisms.

14. The discharge gate assembly according to claim 13, wherein each drive mechanism includes a lost motion connection for allowing the respective drive mechanism to be rotated a predetermined number of degrees during collapse of the lost motion connection before contributing to significant movement of the respective element relative to said frame.

15. The discharge gate assembly according to claim 13, wherein said first and second drive mechanisms each include a rack and pinion assembly arranged in operable combination with the operating shaft assembly of the respective drive mechanism.

16. The discharge gate assembly according to claim 14, wherein the lost motion connection of each drive mechanism includes a slotted configuration arranged in pinions of each rack and pinion assembly.

17. The discharge gate assembly according to claim 15, wherein each rack and pinion assembly includes a pair of racks operably associated with a respective element, and the racks associated with each element being movable along a predetermined path of travel concomitantly with the respective element.

18. The discharge gate assembly according to claim 17, wherein a centerline of each operating shaft assembly is disposed to a common vertical side of the of the predetermined path of travel of the respective racks of each rack and pinion assembly.

19. The discharge gate assembly according to claim 17, wherein the racks operably associated with the first element are operably supported by a pair of laterally spaced extensions on said first element and which are slidably carried on said frame, with each extension being laterally disposed outwardly of the side walls of the frame and move with the first element.

20. The discharge gate assembly according to claim 19, further including a material disposed between an underside of each lateral extension on the first element and said frame for operably reducing the coefficient of friction there between as said first element is moved between closed and open position relative to the discharge opening defined by said frame.

21. The discharge gate assembly according to claim 13, wherein said first element is a discharge gate slidably movable along a generally horizontal path of travel relative to said frame, with said discharge gate an upper surface and a lower surface.

22. The discharge gate assembly according to claim 21, further including support structure disposed beneath the lower surface of said gate and above said second element.

23. The discharge gate assembly according to claim 13, wherein said second element is a pan assembly slidably movable along a generally horizontal path of travel relative to said frame, with said pan assembly defining a pneumatic discharge outlet.

24. The discharge gate assembly according to claim 13, wherein each operating shaft assembly includes cam structure for positively removing said locks from the path of travel of their respective element and in timed relation relative to rotation of either drive mechanism.

25. The discharge gate assembly according to claim 24, wherein the cam structure on said first and second operating shaft assemblies are arranged a predetermined number of degrees out of phase relative to each other.

26. The discharge gate assembly according to claim 25, wherein each operating shaft assembly includes an operating shaft rotatably supported on said frame and capstans removably connected to opposite ends of said operating shaft.

27. The discharge gate assembly according to claim 26, wherein the cam structure of each operating shaft assembly is provided on each capstan.

28. A combination gravity/pneumatic hopper car discharge gate assembly, comprising:

a four sided frame defining a discharge opening, said frame including a pair of generally parallel side walls having diverging angular surfaces extending upwardly from said discharge opening toward an upper surface of said frame and a pair of generally parallel end walls rigidly secured to said side walls, said end walls having diverging angular surfaces extending upwardly from said discharge opening toward the upper surface of said frame, said frame further including spaced and generally parallel extensions extending from and generally parallel to said side walls;

a gate carried on said frame for generally linear sliding movements along a predetermined path of travel and in opposed directions between a closed position, wherein said gate extends across said discharge opening, and an open position;

a vacuum pan assembly carried on said frame beneath said gate for generally linear sliding movements along a predetermined path of travel and in opposed directions between a closed position, wherein said pan assembly extends across said discharge opening, and an open position, with said pan assembly defining a chamber disposed below said gate along with a pneumatic conduit leading therefrom;

a first drive mechanism including a first operating shaft assembly supported for rotation about a first fixed axis by said extensions on said frame for moving said gate between said closed and open positions in response to rotation of said first operating shaft assembly, with said first fixed axis being arranged above the predetermined path of travel of said gate;

a second drive mechanism including a second operating shaft assembly supported for rotation about a second fixed axis by said extensions on said frame for moving said pan assembly between said closed and open positions in response to rotation of said second operating shaft assembly, with said second fixed axis being arranged above the predetermined path of travel of said pan assembly;

a lock assembly supported by said extensions on said frame, said lock assembly including a rock shaft disposed for rotation about a fixed pivot axis disposed between said first and second fixed axes, said lock assembly further including first and second locks mounted on and for rotation with said rock shaft about said pivot axis, with said first lock being movable between a locked condition, wherein said first lock extends into the path of travel of said gate when said gate is in the closed position whereby releasably maintaining said gate in said closed position, and an unlocked condition, and with said second lock being movable between a locked condition, wherein said second lock operably extends into the path of travel of said pan assembly when said pan assembly is in the closed position whereby releasably maintaining said pan assembly in said closed position, and an unlocked condition; and a mechanism for positively removing said first lock from the path of travel of the gate and for positively removing the second lock from the path of travel of the pan assembly in timed relation relative to and caused by rotation of either said first or second drive mechanism.

29. The discharge gate assembly according to claim 28, wherein each operating shaft assembly includes cam structure for positively removing said locks from the path of travel of the respective gate and pan assembly in timed relation relative to rotation of either drive mechanism.

30. The discharge gate assembly according to claim 29, wherein the cam structures on said first and second operating shaft assemblies are arranged a predetermined number of degrees out of phase relative to each other.

31. The discharge gate assembly according to claim 29, wherein each operating shaft assembly includes an operating shaft rotatably supported by said extensions and capstans removably connected to opposite ends of said operating shaft.

32. The discharge gate assembly according to claim 31, wherein the cam structure of each operating shaft assembly is provided on each capstan.

33. The discharge gate assembly according to claim 28, wherein each drive mechanism includes a lost motion connection for allowing the respective drive mechanism to be rotated a predetermined number of degrees during collapse of the lost motion connection whereby operating said mechanism to conjointly and positively remove said first and second locks from the path of travel of the respective gate and pan assembly prior to significant movement of the respective gate and pan assembly relative to said frame.

34. The discharge gate assembly according to claim 33, wherein said first and second drive mechanisms each include a rack and pinion assembly arranged in operable combination with the operating shaft assembly of the respective drive mechanism.

35. The discharge gate assembly according to claim 34, wherein the lost motion connection of each drive mechanism includes a slotted configuration arranged on pinions of each rack and pinion assembly.

36. The discharge gate assembly according to claim 34, wherein each rack and pinion assembly includes a pair of racks operably associated with the respective gate and pan assembly, and the racks associated with said gate and said pan assembly are movable along a predetermined path of travel concomitantly with the respective gate and pan assembly.

37. The discharge gate assembly according to claim 36, wherein the fixed axis of each operating shaft assembly is disposed to a common vertical side of the of the predetermined path of travel of the respective racks of each rack and pinion assembly.

38. The discharge gate assembly according to claim 36, wherein the racks operably associated with the gate are operably supported by a pair of laterally spaced gate extensions slidably carried on said frame, with each gate extension being laterally disposed outwardly of the side walls of the frame and move with the gate.

39. The discharge gate assembly according to claim 38, further including a material disposed between an underside of each gate extension and said frame for operably reducing the coefficient of friction as said gate is moved between closed and open position relative to the discharge opening defined by said frame.

40. A railroad hopper car having an enclosure for holding and transporting material, said enclosure defining toward a bottom thereof an opening through which the material in said enclosure is discharged from said enclosure, and a gate assembly for controlling the discharge of material from said enclosure either pneumatically or gravitationally, said gate assembly comprising:

a frame defining a discharge opening;

a first element carried by said frame for movement between a closed position, wherein said first element extends across said discharge opening, and an open position;

a second element carried by said frame for movement between a closed position, wherein said second element extends across said discharge opening, and an open position, with said first and second elements being arranged on said frame in vertically spaced relation relative to each other;

a first drive mechanism including a first operating shaft assembly mounted on said frame for moving said first element relative to said frame;

a second drive mechanism including a second operating shaft assembly mounted on said frame for moving said second element relative to said frame;

a lock assembly carried by said frame, said lock assembly including a first lock movable between a locked condition, wherein said first lock releasably maintains said first element in said closed position, and an unlocked condition, a second lock movable between a locked condition, wherein said second lock releasably maintains said second element in said closed position, and an unlocked condition; and a mechanism for positively removing said first and second locks from their locked condition relative to their respective elements upon rotation of either one of said first and second drive mechanisms.

41. The railroad hopper car according to claim 40, wherein each drive mechanism of said gate assembly includes a lost motion connection for allowing the respective drive mechanism to be rotated a predetermined number of degrees during collapse of the lost motion connection before contributing to significant movement of the respective element relative to said frame.

42. The railroad hopper car according to claim 40, wherein said first and second drive mechanisms each include a rack and pinion assembly arranged in operable combination with the operating shaft assembly of the respective drive mechanism.

43. The railroad hopper car according to claim 42, wherein each rack and pinion assembly includes a rack operably associated with a respective element, and with each rack being movable along a predetermined path of travel concomitantly with the respective element.

44. The railroad hopper car according to claim 42, wherein a centerline of each operating shaft assembly is disposed to a common vertical side of the of the predetermined path of travel of the respective rack of each rack and pinion assembly.

45. The railroad hopper car according to claim 40, wherein said first element is a discharge gate slidably movable along a generally horizontal path of travel relative to said frame, with said discharge gate having an upper surface and a lower surface.

46. The railroad hopper car according to claim 45, further including support structure disposed beneath the lower surface of said gate and above said second element.

47. The railroad hopper car according to claim 40, wherein said second element is a pan assembly slidably movable along a generally horizontal path of travel relative to said frame, with said pan assembly defining a pneumatic discharge outlet.

48. The railroad hopper car according to claim 40, wherein each operating shaft assembly includes cam structure for positively removing said locks from their locked condition relative to their respective element upon rotation of either of said drive mechanisms.

49. The railroad hopper car according to claim 48, wherein the cam structures on said first and second operating shaft assemblies are arranged a predetermined number of degrees out of phase relative to each other.

50. The railroad hopper car according to claim 48, wherein each operating shaft assembly includes an operating shaft rotatably supported on said frame and capstans removably connected to opposite ends of said operating shaft.

51. The railroad hopper car according to claim 50, wherein the cam structure of each operating shaft assembly is provided on each capstan.

52. A method for controlling discharge of material through an opening defined by a railroad hopper car, said method comprising the steps of:

providing a frame configured for attachment to said hopper car and defining a discharge opening arranged in general registry with the opening defined by the hopper car, said frame including a pair of side walls extending generally parallel to a longitudinal axis of the hopper car and a pair of end walls rigidly interconnected to said side walls;

providing a first element carried by said frame for sliding movements in a single generally horizontal path of travel and relative to said discharge opening between open and closed positions;

providing a second element carried by said frame beneath said first element for sliding movements in a single generally horizontal path of travel and relative to said discharge opening between open and closed positions;

providing a first drive mechanism on said frame for rotation about a first fixed axis for moving said first element relative to said frame;

providing a second drive mechanism on said frame for rotation about a second fixed axis for moving said second element relative to said frame, with said second axis extending generally parallel to said first axis; and arranging a lock assembly in operable combination with said first and second elements, respectively, with said lock assembly including a first stop movable between a locked condition, wherein said first stop extends into the path of travel of said first element when said first element is in the closed position whereby releasably maintaining said first element in said closed position, and an unlocked condition, and a second stop movable between a locked condition, wherein said second stop operably extends into the path of travel of said second element when said second element is in the closed position whereby releasably maintaining said second element in said closed position, and an unlocked condition; and providing a mechanism for conjointly and positively removing said first and second stops from the path of travel of their respective elements upon rotation of either one of said first and second drive mechanisms in a direction to move the respective elements toward an open position.

53. The method for controlling discharge of material through the opening defined by the railroad hopper car according to claim 52, said method further comprising the step of: providing a rack and pinion assembly in operable combination with each element of the gate assembly, each rack and pinion assembly includes a pair of racks operably associated with a respective element, and with the racks associated with each element being movable along a predetermined path of travel concomitantly with the respective element.

54. The method for controlling discharge of material through the opening defined by the railroad hopper car according to claim 52, said method further comprising the step of: arranging a centerline of each drive assembly to a common vertical side of the predetermined path of travel of the respective racks of each rack and pinion assembly.

55. The method for controlling discharge of material through the opening defined by the railroad hopper car according to claim 53, said method further comprising the step of: supporting the racks operably associated with the first element on a pair of laterally spaced extensions on said first element which are slidably carried on the frame, with each extension being laterally disposed outwardly of the side walls of the frame and move with the first element.

56. The method for controlling discharge of material through the opening defined by the railroad hopper car according to claim 55, said method further comprising the step of: providing a material between an underside of each lateral extension on the first element and said frame for operably reducing the coefficient of friction there between as the first element is moved between closed and open position relative to the discharge opening defined by said frame.

* * * * *